US008567897B2

(12) United States Patent
Maruyama et al.

(10) Patent No.: US 8,567,897 B2
(45) Date of Patent: Oct. 29, 2013

(54) CIRCUIT SUBSTRATE

(75) Inventors: Hisanori Maruyama, Fujimi (JP); Noboru Asauchi, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/300,386

(22) Filed: Nov. 18, 2011

(65) Prior Publication Data

US 2012/0127239 A1 May 24, 2012

(30) Foreign Application Priority Data

Nov. 19, 2010 (JP) ..... 2010-258492

(51) Int. Cl.
*B41J 29/393* (2006.01)

(52) U.S. Cl.
USPC ..... 347/19; 347/50; 347/58

(58) Field of Classification Search
USPC ..... 347/19, 58, 86, 87
See application file for complete search history.

(56) References Cited

U.S. PATENT DOCUMENTS

| | | | | |
|---|---|---|---|---|
| 5,274,401 | A * | 12/1993 | Doggett et al. | 347/148 |
| 5,736,997 | A * | 4/1998 | Bolash et al. | 347/19 |
| 6,264,302 | B1 * | 7/2001 | Imanaka et al. | 347/19 |
| 6,332,677 | B1 * | 12/2001 | Steinfield et al. | 347/87 |
| 6,431,678 | B2 * | 8/2002 | Beck et al. | 347/19 |
| 6,758,547 | B2 * | 7/2004 | Ahne et al. | 347/19 |
| 6,778,198 | B2 * | 8/2004 | Dances | 347/148 |
| 7,040,739 | B2 * | 5/2006 | Kim et al. | 347/58 |
| 7,102,860 | B2 * | 9/2006 | Wenzel | 361/18 |
| 7,495,878 | B2 * | 2/2009 | Todd | 361/111 |
| 7,764,510 | B2 * | 7/2010 | Shibasaki et al. | 361/781 |
| 7,780,266 | B2 * | 8/2010 | Andrews | 347/50 |
| 7,784,909 | B2 * | 8/2010 | Anderson et al. | 347/50 |
| 7,971,945 | B2 * | 7/2011 | Tsukada et al. | 347/7 |
| 8,116,057 | B2 * | 2/2012 | Whitby-Strevens | 361/119 |
| 2002/0024559 | A1 * | 2/2002 | Murray et al. | 347/50 |
| 2002/0039270 | A1 * | 4/2002 | Sato | 361/93.1 |
| 2008/0170102 | A1 * | 7/2008 | Kim et al. | 347/50 |
| 2009/0040274 | A1 * | 2/2009 | Shinada et al. | 347/50 |
| 2009/0102029 | A1 * | 4/2009 | Tadaoka | 257/673 |
| 2009/0309911 | A1 * | 12/2009 | Kim | 347/14 |
| 2009/0309929 | A1 * | 12/2009 | Kanda et al. | 347/50 |
| 2009/0309930 | A1 * | 12/2009 | Tamura et al. | 347/50 |
| 2010/0060681 | A1 * | 3/2010 | Uchiyama | 347/9 |
| 2012/0056955 | A1 * | 3/2012 | Kodama et al. | 347/86 |
| 2012/0236063 | A1 * | 9/2012 | Nakazawa | 347/19 |

FOREIGN PATENT DOCUMENTS

| | | | |
|---|---|---|---|
| EP | 1 800 872 | A1 | 6/2007 |
| JP | 2010-228464 | A | 10/2010 |
| WO | WO 9804414 | A1 * | 2/1998 |

* cited by examiner

*Primary Examiner* — Matthew Luu
*Assistant Examiner* — Patrick King
(74) *Attorney, Agent, or Firm* — Kilpatrick Townsend & Stockton LLP

(57) ABSTRACT

A circuit substrate includes a first terminal connected to a storage device, a second terminal to which voltage higher than voltage which is applied to the first terminal is applied, and a third terminal. The third terminal is disposed adjacent to the first terminal and the second terminal and connected to an overvoltage detection section provided in a printer. A convex portion is provided on a substrate surface between the first terminal and the second terminal, and a configuration is made such that a liquid droplet easily spreads from the second terminal to the third terminal rather than the liquid droplet spreading from the second terminal to the first terminal.

4 Claims, 25 Drawing Sheets

ERECTED

INCLINED TO RIGHT

INCLINED TO LEFT

DURING NORMAL OPERATION

POOR CONTACT OF TERMINAL 250 OR 290

POOR CONTACT OF TERMINAL 210 OR 240

LEAK BETWEEN TERMINALS 240 AND 290

LEAK BETWEEN TERMINALS 210 AND 250

NO LEAK

LEAK BETWEEN TERMINALS 240 AND 290

LEAK BETWEEN TERMINALS 210 AND 250

MODIFIED EXAMPLE 1 OF MOUNTING DETECTION SIGNAL

MODIFIED EXAMPLE 2 OF MOUNTING DETECTION SIGNAL $$I_{DET}=\frac{VHV}{R_c} \qquad R_c=R\frac{1}{\sum_{j=1}^{N}\frac{1}{2^j}}$$

CIRCUIT SUBSTRATE

BACKGROUND

1. Technical Field

The present invention relates to a circuit substrate for a printing material cartridge which is used in a printer.

2. Related Art

In recent years, as a printing material cartridge, a cartridge with a storage device storing the information (for example, the amount of ink remaining) about a printing material mounted thereon has been used. For example, in JP-A-2010-228464, a substrate provided with a storage device is mounted on an ink cartridge. Further, at the substrate, in addition to a terminal (also referred to as a "terminal for memory") which is connected to the storage device, a high-voltage terminal to which voltage higher than that of the terminal for memory is applied and a terminal (referred to as a "short-circuit detection terminal" or an "overvoltage detection terminal") which detects a short circuit of the terminal and the high-voltage terminal are provided. The overvoltage detection terminal is intended to prevent application of excessively high voltage to the terminal for memory before it happens, thereby preventing damage to the storage device.

However, when a liquid droplet (ink or the like) has been attached to the high-voltage terminal, there is a case where the liquid droplet spreads from the high-voltage terminal toward the terminal for memory, so that overvoltage cannot be detected by the overvoltage detection terminal. That is, in the configuration of an existing circuit substrate, there is a case where it is not possible to sufficiently utilize the function of the overvoltage detection terminal and excessively high voltage is applied to the terminal for memory ahead of the overvoltage detection terminal.

In addition, the various problems mentioned above are not limited to a circuit substrate for the ink cartridge and are the same also with respect to a circuit substrate for a printing material cartridge in which another type of printing material (for example, toner) is accommodated. Further, also with respect to a liquid ejecting apparatus which ejects another type of liquid other than the printing material and a circuit substrate which is used in a liquid accommodating container (a liquid accommodating body) for the apparatus, there is the same problem.

SUMMARY

An advantage of some aspects of the invention is that it prevents a phenomenon in which when a liquid droplet (ink or the like) has been attached to a high-voltage terminal, since the liquid droplet spreads from the high-voltage terminal toward a terminal for memory, overvoltage is applied to the terminal for memory ahead of an overvoltage detection terminal.

The invention can be realized as the following forms and applications.

Application 1

A circuit substrate capable of being electrically connected to a plurality of apparatus-side terminals of a printer includes: a storage device; at least one first terminal connected to the storage device; at least one second terminal to which voltage higher than voltage which is applied to the first terminal is applied; and at least one third terminal, wherein the third terminal is disposed adjacent to the first terminal and the second terminal on the substrate surface of the circuit substrate, the third terminal is a terminal which is connected to an overvoltage detection section provided in the printer in order to detect high voltage which is applied to the third terminal by a short circuit of the second terminal and the third terminal, and a convex portion is provided on the substrate surface between the first terminal and the second terminal, whereby in a case where a liquid droplet has been attached to the second terminal, the liquid droplet easily spreads from the second terminal to the third terminal rather than the liquid droplet spreading from the second terminal to the first terminal.

According to this configuration, even when a liquid droplet has been attached to the second terminal (a high-voltage terminal), since the convex portion provided between the first terminal (a terminal for memory) and the second terminal (the high-voltage terminal) functions as a barrier for the liquid droplet, spread of the liquid droplet is prevented. Therefore, it is possible to prevent a phenomenon in which overvoltage is applied to the first terminal (the terminal for memory) ahead of the third terminal (an overvoltage detection terminal).

Application 2

In the circuit substrate according to Application 1, the convex portion may include a resist coating provided on the surface of the convex portion.

According to this configuration, since the resist coating is non-conductive, even if a liquid droplet spreads up to the position of the convex portion, overvoltage is not applied to the first terminal (the terminal for memory). Further, it is possible to easily form the convex portion which functions as a barrier for the liquid droplet, by using a resist coating which is commonly used for the protection of the substrate surface.

Application 3

In the circuit substrate according to Application 2, the convex portion may include a wiring laid-out so as to pass between the first terminal and the second terminal, and the resist coating which covers the wiring.

In this configuration, since the convex portion includes both the wiring and the resist coating, it is possible to make the height of the convex portion sufficiently large, so that it is possible to increase a function as a barrier for the liquid droplet.

Application 4

In the circuit substrate according to Application 3, the first terminal may be provided in a plurality on the substrate surface, the second terminal and the third terminal may be provided two each on the substrate surface, the first to third terminals may be arranged so as to constitute a first row and a second row, the two second terminals may be disposed at both ends of the second row, the two third terminals may be disposed at both ends of the first row, the two third terminals may be connected to each other through the wiring laid-out so as to pass between the first terminal and the second terminal, and the wiring which is included in the convex portion is a portion of the wiring which connects the two third terminals to each other.

In this configuration, since the convex portion is formed using a portion of the wiring for connecting the two third terminals, there is no need to form a special wiring or the like for the convex portion.

In addition, the invention can be realized in various forms and can be realized in the forms of, for example, a printing material cartridge, a printing material cartridge set constituted by plural types of printing material cartridges, a cartridge adapter, a cartridge adapter set constituted by plural types of cartridge adapters, a circuit substrate, a printer, a liquid ejecting apparatus, a printing material supply system provided with a printer and a cartridge, a liquid supply system provided with a liquid ejecting apparatus and a cartridge, and a detection method of the mounting state of a cartridge or a circuit substrate, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment of Circuit Substrate

Figure 1A:
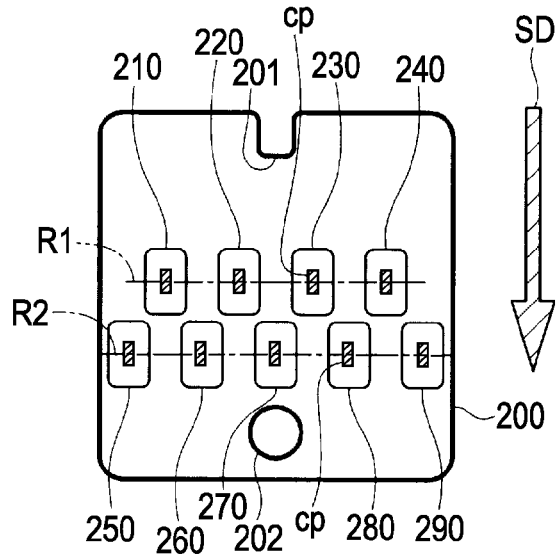
FIGS. 1A to 1C are diagrams showing an embodiment of a substrate.

FIG. 1A shows the configuration of the surface of a circuit substrate 200 in an embodiment of the invention. Hereinafter, the circuit substrate will also be simply referred to as a "substrate". The substrate 200 is mounted on an ink cartridge (described later). The surface of the substrate 200 is a surface which is exposed to the outside when the substrate 200 has been mounted on the ink cartridge. A boss groove 201 is formed at an upper end portion of the substrate 200 and a boss hole 202 is formed at a lower end portion of the substrate 200.

An arrow SD in FIG. 1A indicates the mounting direction of the cartridge on a cartridge mounting section (described later) provided in a printer. On the rear surface of the substrate 200, a storage device (not shown) is provided, and on the surface, a terminal group composed of nine terminals 210, 220, 230, 240, 250, 260, 270, 280, and 290 is provided. The terminals 210, 220, 230, 240, 250, 260, 270, 280, and 290 are used as electrode terminals which respectively come into contact with apparatus-side terminals provided in the printer. In addition, the terminals 210, 220, 230, 240, 250, 260, 270, 280, and 290 are also referred to as "contact terminals". The storage device which is provided at the substrate 200 is used to store, for example, the information (for example, the amount of ink remaining) about ink in a cartridge 100. The terminals 210, 220, 230, 240, 250, 260, 270, 280, and 290 are formed into an approximately rectangular shape and disposed so as to form two rows approximately perpendicular to the mounting direction SD. Among the two rows, a row (a row which is located on the upper side in FIG. 1A) on the front side in the mounting direction SD is referred to as an upper row R1 (a first row) and a row (a row which is located on the lower side in FIG. 1A) on the back side in the mounting direction SD is referred to as a lower row R2 (a second row). In addition, these rows R1 and R2 can also be considered to be rows which are formed by contact portions cp of a plurality of terminals.

In an embodiment, the terminals 210, 220, 230, and 240 forming the upper row R1 and the terminals 250, 260, 270, 280, and 290 forming the lower row R2 respectively have the following functions (uses).

The upper row R1

(1) Overvoltage detection terminal 210

(2) Terminal for memory 220 (reset terminal)

(3) Terminal for memory 230 (clock terminal)

(4) Overvoltage detection terminal 240

The lower row R2

(5) High-voltage terminal 250

(6) Terminal for memory 260 (power supply terminal)

(7) Terminal for memory 270 (earth terminal)
(8) Terminal for memory 280 (data terminal)
(9) High-voltage terminal 290

The five terminals for memory 220, 230, 260, 270, and 280 are terminals connected to the storage device provided at the substrate 200. However, what functions (uses) are assigned to the plurality of terminals for memory is optional. The two high-voltage terminals 250 and 290 are terminals to which voltage higher than that in the terminal for memory is applied. These high-voltage terminals 250 and 290 are connected to a high-voltage device (a device which operates at a voltage higher than that in the storage device) provided at the substrate 200. An example of the high-voltage device will be described later.

The overvoltage detection terminal 210 (or 240) is a terminal for detecting an excessively high voltage (referred to as "overvoltage") which is generated in the overvoltage detection terminal 210 (or 240) due to an unintended short circuit between the high-voltage terminal 250 (or 290) and the overvoltage detection terminal 210 (or 240). The overvoltage is a voltage higher than a power-supply voltage which is applied to the power supply terminal 260 among the terminals for memory. The overvoltage detection terminal 210 (or 240) is disposed at a position adjacent to both the high-voltage terminal 250 (or 290) and at least one terminal for memory 260 (or 280). Further, the overvoltage detection terminals 210 and 240 are connected to an overvoltage detection section (described later) provided in the printer.

Each of the plurality of terminals 210, 220, 230, 240, 250, 260, 270, 280, and 290 includes at the central portion thereof the contact portion cp which comes into contact with a corresponding terminal among a plurality of apparatus-side terminals provided in the printer. The respective contact portions cp of the terminals 210, 220, 230, and 240 forming the upper row R1 and the respective contact portions cp of the terminals 250, 260, 270, 280, and 290 forming the lower row R2 are alternately disposed, thereby configuring so-called zigzag disposition. Further, the terminals 210, 220, 230, and 240 forming the upper row R1 and the terminals 250, 260, 270, 280, and 290 forming the lower row R2 are also alternately disposed such that each other's terminal centers do not line up in the mounting direction SD, thereby configuring zigzag disposition.

The two overvoltage detection terminals 210 and 240 of the upper row R1 and the contact portions thereof are respectively disposed at both end portions of the upper row R1, that is, at the outermost of the upper row R1. Further, the two high-voltage terminals 250 and 290 of the lower row R2 and the contact portions thereof are respectively disposed at both end portions of the lower row R2, that is, at the outermost of the lower row R2. The terminals for memory 220, 230, 260, 270, and 280 and the contact portions thereof are gathered and disposed approximately at the center in an area where all of the plurality of terminals 210, 220, 230, 240, 250, 260, 270, 280, and 290 are disposed.

Figure 1B:
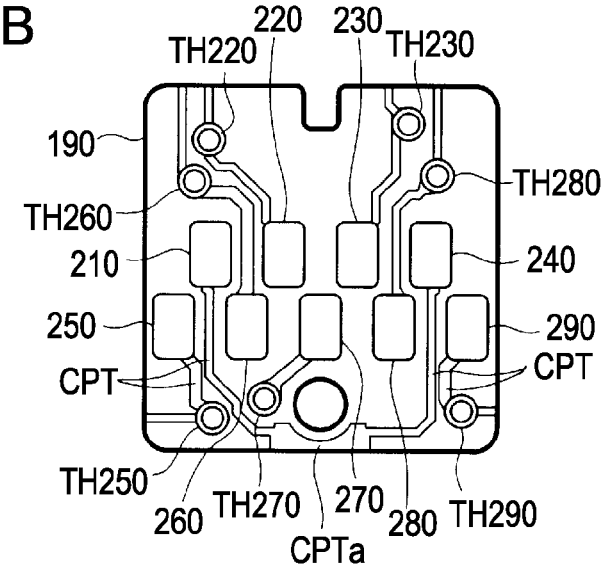

FIG. 1B shows one example of a conductor pattern formed on the surface of an insulation base material 190 of the substrate 200. Here, in addition to the nine terminals 210, 220, 230, 240, 250, 260, 270, 280, and 290 shown in FIG. 1A, wirings CPT each formed by a conductor and seven through-holes TH220, TH230, TH250, TH260, TH270, TH280, and TH290 are formed. The seven through-holes are respectively connected to some terminals by the wiring CPT. The three-digit number of the end of the symbol attached to each through-hole indicates the terminal which is connected each through-hole. For example, the through-hole TH220 which is present in the upper left of FIG. 1B is connected to the terminal 220. Each through-hole penetrates the insulation base material 190 and electrically connects the surface and the rear surface. Also on the rear surface side of each through-hole, a wiring or a terminal is formed, and the storage device or the high-voltage device is connected thereto through the wiring or the terminal.

In FIG. 1B, the two overvoltage terminals 210 and 240 are short-circuited and connected to each other by a wiring CPTa formed on the surface of the substrate 200 (strictly, the surface of the insulation base material). More specifically, the wiring CPTa extends downward from a lower end of the first overvoltage terminal 210, passes between the first high-voltage terminal 250 and the terminal for memory 260, reaches a lower end of the substrate 200, then extends upward from the lower end of the substrate 200, passes between the second high-voltage terminal 290 and the terminal for memory 280, and reaches the second overvoltage terminal 240.

Figure 1C:
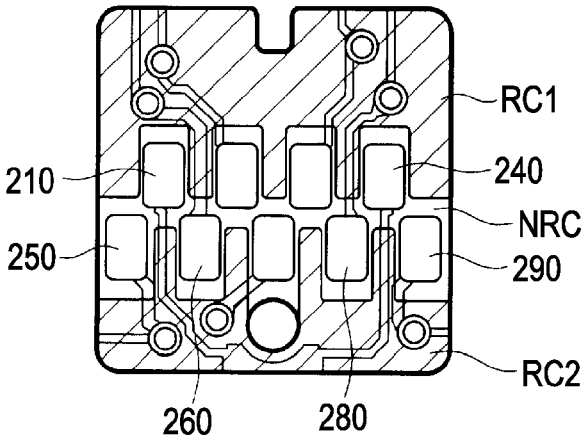

FIG. 1C shows a state where resist coatings RC1 and RC2 are formed on the conductor pattern in FIG. 1B. Since the nine terminals 210, 220, 230, 240, 250, 260, 270, 280, and 290 shown in FIG. 1A are used as electrode terminals which respectively come into contact with the apparatus-side terminals provided in the printer, the terminals 210, 220, 230, 240, 250, 260, 270, 280, and 290 are maintained in a state where they are not covered by the resist coatings RC1 and RC2. In the state of FIG. 1C, one resist opening portion NRC (an area where the resist coating is not present) is formed over one area which includes the nine terminals 210, 220, 230, 240, 250, 260, 270, 280, and 290. Further, the upper resist coating RC1 and the lower resist coating RC2 are separated from each other with the resist opening portion NRC interposed therebetween. A lower end of the upper resist coating RC1 is formed into a comb-tooth shape and the comb teeth and the terminals 210, 220, 230, and 240 are disposed alternately one by one. Further, an upper end of the lower resist coating RC2 is also formed into a comb-tooth shape and the comb teeth and the terminals 250, 260, 270, 280, and 290 are disposed alternately one by one. In addition, all areas other than the nine terminals 210, 220, 230, 240, 250, 260, 270, 280, and 290 of the surface of the substrate 200 may also be made to be covered by a resist coating.

Figure 2A:
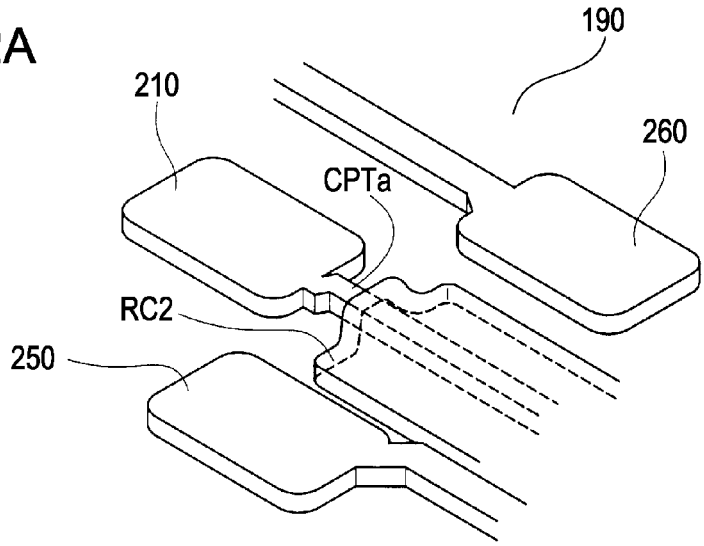
FIGS. 2A to 2C are perspective views showing an overvoltage detection terminal, a high-voltage terminal, and a terminal for memory.
Figure 2B:
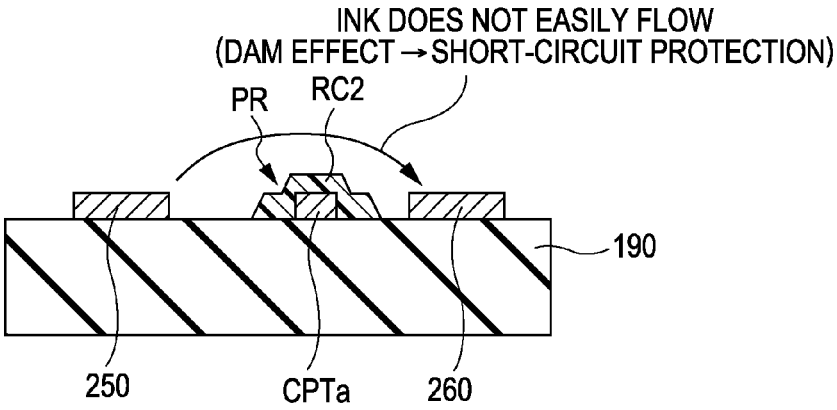

FIG. 2A is a perspective view showing the overvoltage detection terminal 210, the high-voltage terminal 250, and the terminal for memory 260. As explained in FIG. 1C, on the wiring CPTa connected to the overvoltage terminal 210, the resist coating RC2 is formed. FIG. 2B is a cross-sectional view showing the relationship between the heights of the high-voltage terminal 250, the terminal for memory 260 adjacent to the high-voltage terminal 250, the wiring CPTa provided between these terminals 250 and 260, and the resist coating RC2. In one embodiment, all of the heights (thicknesses) of the terminals 210 and 260 and the height (thickness) of the wiring CPTa measured from the surface of the insulation base material 190 are set to be about 30 μm. Further, the height (thickness) of the resist coating RC2 is set to be about 20 μm. At this time, the height of a convex portion PR in which the wiring CPTa and the resist coating RC2 overlap becomes about 40 μm. The reason that the height of the convex portion PR does not become the sum of the height of the wiring CPTa and the height of the resist coating RC2 is because when resist in the form of liquid has been coated, the thickness of resist liquid covering the wiring CPTa becomes small. Also in this case, since the convex portion PR in which the wiring CPTa and the resist coating RC2 overlap functions as a barrier for a liquid droplet, it is possible to prevent a phenomenon in which a liquid droplet such as ink spreads from the high-voltage terminal 250 to the terminal for memory 260. Therefore, even in a case where a liquid droplet has been attached to the high-voltage terminal 250, a phenomenon can be prevented in which the liquid droplet spreads from the high-voltage terminal 250 to the terminal for memory 260, so that a short circuit is generated between the terminals 250 and 260, whereby overvoltage is applied to the terminal for memory 260. In addition, such an effect of the convex portion PR is also called a "dam effect".

Figure 2C:
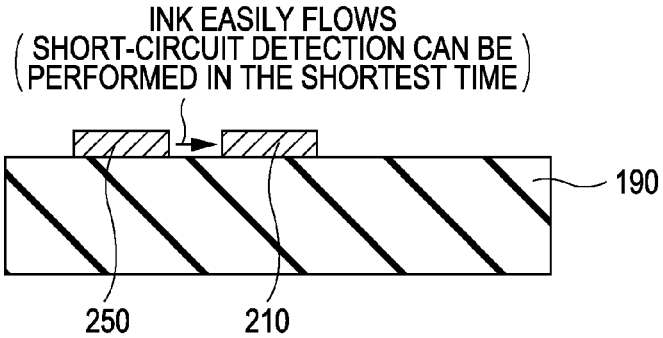

FIG. 2C is a cross-sectional view showing the relationship between the heights of the high-voltage terminal 250 and the overvoltage detection terminal 210 adjacent thereto. As also explained in FIG. 1C, the high-voltage terminal 250 and the overvoltage detection terminal 210 are disposed in the resist opening portion NRC in which the resist coating is not formed on the surface of the insulation base material 190. The convex portion PR as shown in FIG. 2B is not present between these terminals 250 and 210. As can be understood from comparison of FIG. 2C with FIG. 2B, if a liquid droplet is attached to the high-voltage terminal 250, a configuration is made in which the liquid droplet more easily spreads from the high-voltage terminal 250 to the overvoltage terminal 210 rather than the liquid droplet spreading from the high-voltage terminal 250 to the terminal for memory 260. Therefore, since a possibility that overvoltage may be detected at first by the overvoltage detection terminal 210 at the point of time before overvoltage is applied to the terminal for memory 260 is high, a possibility that the storage device may be damaged by overvoltage can be reduced.

In addition, the two overvoltage terminals 210 and 240 are short-circuited and connected to each other by the wiring CPTa and the convex portion PR shown in FIG. 2B is a portion in which the resist coating RC2 is formed on the wiring CPTa. In this manner, in the embodiment shown in FIGS. 1A to 1C and 2A to 2C, the convex portion PR having the dam effect is formed using the wiring CPTa for short-circuiting and connecting the two overvoltage terminals 210 and 240. Therefore, there is an advantage that it is not necessary to provide a special structure (an originally unnecessary conductor pattern or the like) for forming the convex portion PR. However, in order to form the convex portion PR, conductors which are not connected to any terminal may also be respectively provided between the terminals 250 and 260 and between the terminals 280 and 290.

Figure 3A:
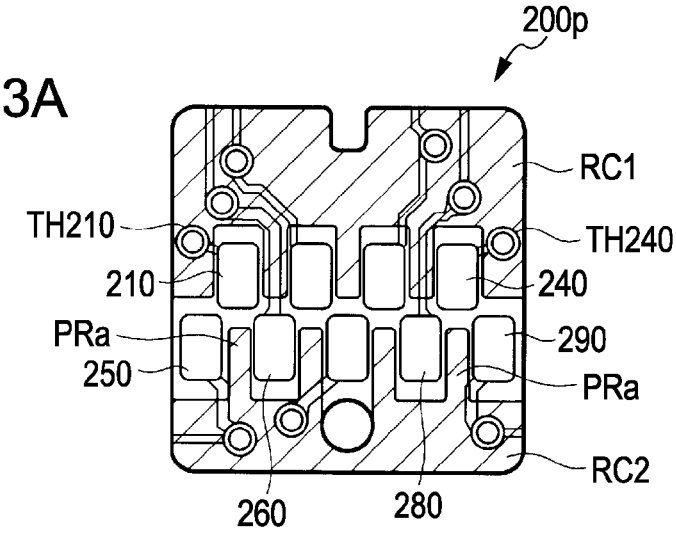
FIGS. 3A to 3C are diagrams showing other embodiments of the substrate.

FIG. 3A shows another embodiment of the circuit substrate. A substrate 200*p* in FIG. 3A is a substrate in which the wiring CPTa (a connection wiring between the overvoltage detection terminals 210 and 240) in FIG. 1C is omitted and instead, through-holes TH210 and TH240 for the overvoltage detection terminals 210 and 240 are provided. The overvoltage detection terminals 210 and 240 are short-circuited and connected to each other through a wiring (not shown) formed on the rear surface of the substrate through the through-holes TH210 and TH240. In this case, a convex portion PRa between the high-voltage terminal 250 and the terminal for memory 260 is constituted only by the resist coating RC2. Therefore, the convex portion PRa is lower in height than the convex portion PR (including the wiring CPTa and the resist coating RC2) shown in FIG. 2B and a function as a barrier for a liquid droplet is also slightly low. However, also in the substrate 200*p* in FIG. 3A, it has in common with the substrate shown in FIG. 1C that a configuration is made in which when a liquid droplet has been attached to the high-voltage terminal 250, the liquid droplet more easily spreads from the high-voltage terminal 250 to the overvoltage terminal 210 rather than the liquid droplet spreading from the high-voltage terminal 250 to the terminal for memory 260.

Figure 3B:
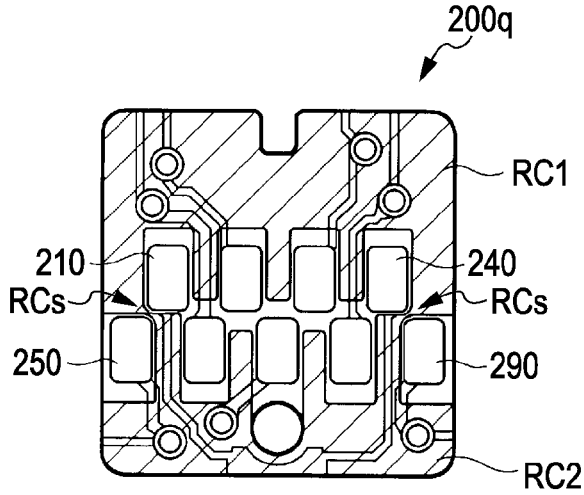

FIG. 3B shows still another embodiment of the circuit substrate. A substrate 200*q* in FIG. 3B has a configuration in which a resist coating RCs is also provided between the overvoltage detection terminal 210 (or 240) and the high-voltage terminal 250 (or 290) in FIG. 1C. In this substrate 200*q*, unlike FIG. 2C, the resist coating RCs is present between the overvoltage detection terminal 210 and the high-voltage terminal 250. However, the height of the resist coating RCs is lower than that of the convex portion PR shown in FIG. 2B. Therefore, also in the substrate 200*q* in FIG. 3B, it has in common with the substrate shown in FIG. 1C that a configuration is made in which when a liquid droplet has been attached to the high-voltage terminal 250, the liquid droplet more easily spreads from the high-voltage terminal 250 to the overvoltage terminal 210 rather than the liquid droplet spreading from the high-voltage terminal 250 to the terminal for memory 260. As can be understood from this example, in a case where a convex portion (for example, the resist coating RCs) protruding from the surface of the insulation base material 190 is present between the overvoltage detection terminal 210 (or 240) and the high-voltage terminal 250 (or 290), it is preferable that the convex portion PR between the high-voltage terminal 250 (or 290) and the terminal for memory 260 (or 280) be larger in height than the above convex portion.

Figure 3C:
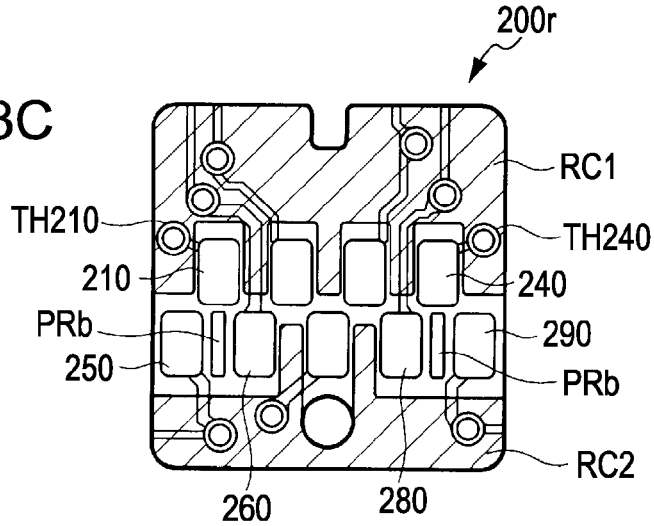

FIG. 3C shows still yet another embodiment of the circuit substrate. A substrate 200*r* in FIG. 3C has a configuration in which in place of the convex portion PRa of the resist coating in FIG. 3A, another convex portion PRb is provided. The convex portion PRb may also be formed of a non-conductive material such as a resist coating or may also be formed of an electrically-conductive material such as a terminal or a wiring. In addition, in a case where the convex portion PRb is formed of an electrically-conductive material, it is preferable that the convex portion PRb is not short-circuited and connected to the terminal for memory. However, the convex portion PRb may also be short-circuited and connected to the overvoltage detection terminal. Also in this substrate 200*r*, it has in common with the substrate shown in FIG. 1C that a configuration is made in which when a liquid droplet has been attached to the high-voltage terminal 250, the liquid droplet more easily spreads from the high-voltage terminal 250 to the overvoltage terminal 210 rather than the liquid droplet spreading from the high-voltage terminal 250 to the terminal for memory 260.

As can also be understood from the several examples, as the circuit substrate, it is possible to adopt any circuit substrate configured such that a convex portion is provided on the substrate surface between the terminal for memory (a first terminal) and the high-voltage terminal (a second terminal), whereby in a case where a liquid droplet has been attached to the high-voltage terminal (the second terminal), the liquid droplet easily spreads from the high-voltage terminal (the second terminal) to the overvoltage detection terminal (a third terminal) rather than the liquid droplet spreading from the high-voltage terminal (the second terminal) to the terminal for memory (the first terminal). In addition, it is preferable that the convex portion which is formed between the terminal for memory (the first terminal) and the high-voltage terminal (the second terminal) have a non-conductive surface. Further, in a case where some sort of convex portion is present between the high-voltage terminal (the second terminal) and the overvoltage detection terminal (the third terminal), it is preferable that the convex portion provided between the terminal for memory (the first terminal) and the high-voltage terminals (the second terminal) be larger in height than the above convex portion.

In addition, the number or the array of terminals or wirings on the substrate can be optionally changed from those shown in FIGS. 1A to 3C. However, it is preferable to provide at least one terminal for memory, at least one high-voltage terminal, and at least one overvoltage detection terminal on the substrate. Also in this case, it is preferable that the overvoltage detection terminal be disposed at a position adjacent to both the high-voltage terminal and the terminal for memory. In addition, in embodiments of a printing system which are described below, specific examples of the terminal array of the substrate are described. However, with regard to the wiring pattern, the through-hole, the resist coating, or the like, illustration and explanation are omitted.

B. First Embodiment of Printing System

Figure 4:
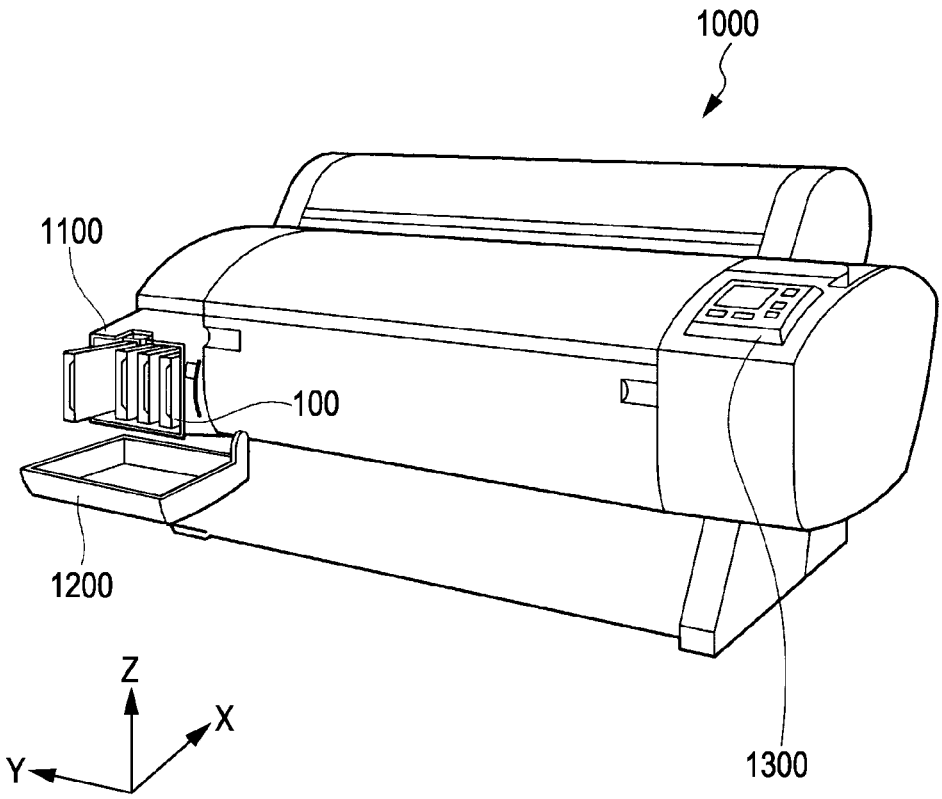
FIG. 4 is a perspective view showing the configuration of a printer in a first embodiment of a printing system according to the invention.

FIG. 4 is a perspective view showing the configuration of the printer in one embodiment of a printing system according to the invention. A printer 1000 includes a cartridge mounting section 1100 on which the ink cartridges are mounted, a cover 1200 capable of turning, and an operating section 1300. The printer 1000 is a large format ink jet printer which performs printing on large-sized paper (A2-size to A0-size or the like) such as a poster. The cartridge mounting section 1100 is also referred to as a "cartridge holder" or simply a "holder". In the example shown in FIG. 4, four ink cartridges can be independently mounted on the cartridge mounting section 1100 and four types of ink cartridges of, for example, black, yellow, magenta, and cyan are mounted. In addition, as the ink cartridge which is mounted on the cartridge mounting section 1100, it is possible to adopt plural types of any ink cartridges other than these. In FIG. 4, for convenience of explanation, XYZ axes orthogonal to each other are depicted. A +X direction is a direction (hereinafter referred to as an "insertion direction" or a "mounting direction") in which the ink cartridge 100 is inserted into the cartridge mounting section 1100. The cover 1200 is mounted on the cartridge mounting section 1100 so as to be able to be opened and closed. The cover 1200 may be omitted. The operating section 1300 is an input device for making a user perform various instructions or setting and is provided with a display section for giving a user various notices. In addition, the printer 1000 has a printing head, a main scanning feed mechanism for performing the scanning of the printing head, a sub-scanning feed mechanism, a head driving mechanism which drives the printing head to discharge ink, and the like. However, here, illustration is omitted. The type of a printer in which a cartridge which is replaced by a user is mounted on a cartridge mounting section provided at a place other than a carriage of a printing head, as in the printer 1000, is called an "off-carriage type".

Figure 5B:
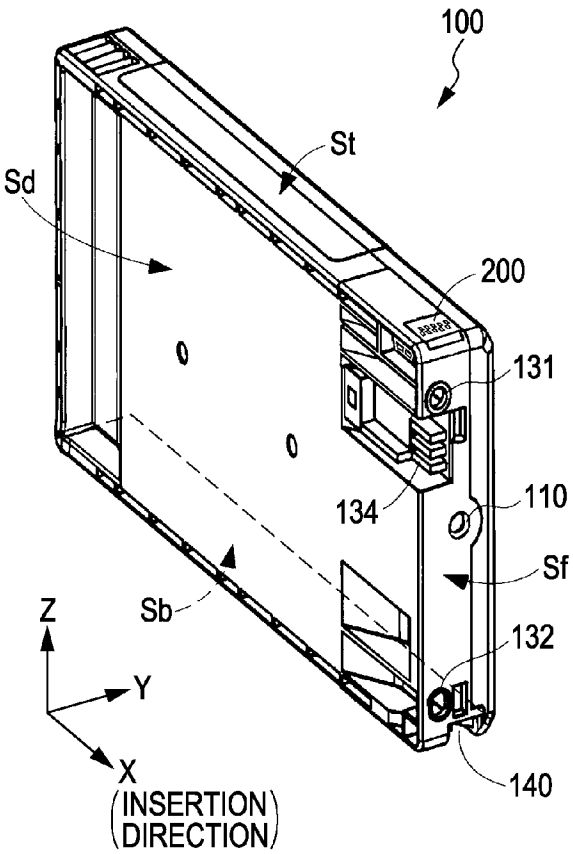
FIGS. 5A and 5B are perspective views showing the configuration of an ink cartridge.
Figure 5A:
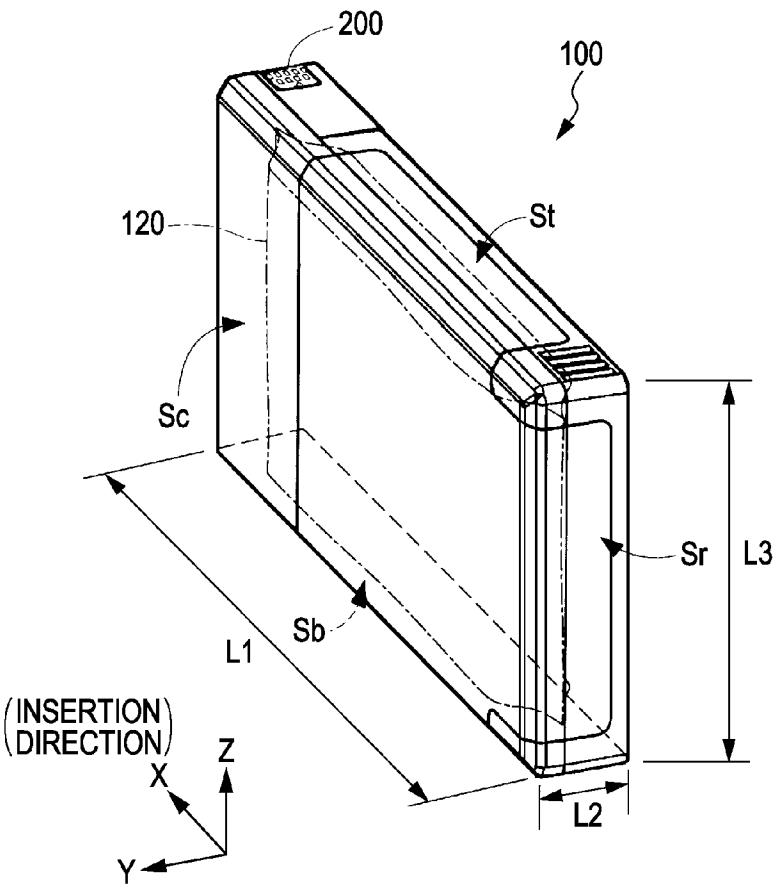

FIGS. 5A and 5B are perspective views showing the appearance of the ink cartridge 100. The XYZ axes in FIGS. 5A and 5B correspond to the XYZ axes in FIG. 4. In addition, the ink cartridge is also simply referred to as a "cartridge". The cartridge 100 has an exterior shape of an approximately rectangular flat parallelepiped, and among dimensions L1, L2, and L3 in three directions, a length L1 (a size in the insertion direction) is largest, a width L2 is smallest, and a height L3 is intermediate between the length L1 and the width L2. However, according to the type of a printer, a cartridge in which the length L1 is smaller than the height L3 is also present.

The cartridge 100 has a leading end surface (a first surface) Sf, a back end surface (a second surface) Sr, a ceiling surface (a third surface) St, a bottom surface (a fourth surface) Sb, and two side surfaces (fifth and sixth surfaces) Sc and Sd. The leading end surface Sf is a surface which is located at a head in the insertion direction X. The leading end surface Sf and the back end surface Sr are smallest among the six surfaces and face each other. Each of the leading end surface Sf and the back end surface Sr intersects the ceiling surface St, the bottom surface Sb, and the two side surfaces Sc and Sd. In a state where the cartridge 100 has been mounted on the cartridge mounting section 1100, the ceiling surface St is located at an upper end in the vertical direction and the bottom surface Sb is located at a lower end in vertical direction. The two side surfaces Sc and Sd are largest surfaces among the six surfaces and face each other. In the inside of the cartridge 100, an ink accommodating chamber 120 (also referred to as an "ink accommodating bag") formed of a flexible material is provided. Since the ink accommodating chamber 120 is formed of a flexible material, the ink accommodating chamber 120 gradually contracts in accordance with the consumption of ink, so that mainly the thickness (the width in the Y direction) becomes smaller.

The leading end surface Sf has two positioning holes 131 and 132 and an ink supply port 110. The two positioning holes 131 and 132 are used to determine an accommodation position of the cartridge in the cartridge mounting section 1100. The ink supply port 110 is connected to an ink supply tube of the cartridge mounting section 1100, thereby supplying ink in the cartridge 100 to the printer 1000. On the ceiling surface St, the circuit substrate 200 is provided. In the example shown in FIGS. 5A and 5B, the circuit substrate 200 is provided at a leading end (an end portion on the inmost side in the insertion direction X) of the ceiling surface St. However, the circuit substrate 200 may also be provided at another position near the leading end of the ceiling surface St. Further, the circuit substrate 200 may also be provided at a position other than the ceiling surface St. On the circuit substrate 200, a nonvolatile storage element for storing the information about ink is mounted. In addition, the circuit substrate 200 is also simply referred to as a "substrate". The bottom surface Sb has a fixing groove 140 which is used to fix the cartridge 100 at the accommodating position. The first side surface Sc and the second side surface Sd face each other and are perpendicular to the leading end surface Sf, the ceiling surface St, the back end surface Sr, and the bottom surface Sb. At a position where the second side surface Sd and the leading end surface Sf intersect each other, a concavo-convex fitting portion 134 is disposed. The concavo-convex fitting portion 134 is used to prevent erroneous mounting of the cartridge, along with a concavo-convex fitting portion of the cartridge mounting section 1100.

The cartridge 100 is a cartridge for the large format ink jet printer, and in the cartridge 100, compared to a cartridge for a small ink jet printer for individuals, the cartridge dimensions are large and the amount of ink which is accommodated is also large. For example, the length L1 of the cartridge is 100 mm or more in the cartridge for the large format ink jet printer, whereas it is 70 mm or less in the cartridge for the small ink jet printer. Further, the amount of ink at the time of unused is 17 ml or more (typically, 100 ml or more) in the cartridge for the large format ink jet printer, whereas it is 15 ml or less in the cartridge for the small ink jet printer. Further, in many cases, the cartridge for the large format ink jet printer is mechanically connected to a cartridge mounting section at the leading end surface (a surface of a head in the insertion direction) thereof, whereas the cartridge for the small ink jet printer is mechanically connected to a cartridge mounting section at the bottom surface thereof. In the cartridge for the large format ink jet printer, due to a characteristic point related to such a dimension, weight, or a connection position to the cartridge mounting section, poor contact in the terminal of the circuit substrate 200 tends to be easily generated, compared to the cartridge for the small ink jet printer. This point will be further described later.

Incidentally, in the past, detection of a mounting state has been usually performed using one or two terminals among a number of terminals provided to a cartridge. However, even in a case where correct mounting of the cartridge has been detected, with respect to other terminals which are not used for the mounting detection, there is a case where contact with terminals of a printer is insufficient. In particular, in a case where contact of a terminal for storage device is insufficient, a problem arises in which an error occurs at the time of the readout of data from the storage device or the time of writing of data to the storage device.

Such a problem of poor contact of the terminal is particularly important in the cartridge for the large format ink jet printer which performs printing on large-sized paper (A2-size to A0-size, or the like) such as a poster. That is, in the large format ink jet printer, the dimensions of the ink cartridge are large compared to that in the small ink jet printer and the weight of ink which is accommodated in the cartridge is also large. The inventors have found that due to such differences in dimension and weight, in the large format ink jet printer, the ink cartridge tends to be easily tilted, compared to the small ink jet printer. Further, in the large format ink jet printer, a connection position of the ink cartridge to a cartridge holder (also referred to as a "cartridge mounting section") is often provided at a side surface of the ink cartridge, and on the other hand, in the small ink jet printer, the connection position is often provided at the bottom surface of the ink cartridge. It has been found that also due to such a difference in connection position, in the large format ink jet printer, the ink cartridge tends to be easily tilted, compared to the small ink jet printer. In this manner, in the large format ink jet printer, due to various configurations, the ink cartridge is apt to be tilted, compared to the small ink jet printer, and as a result, poor contact in a terminal of a substrate tends to easily occur. Therefore, the inventors have desired that with regard particularly to the large format ink jet printer, there is a desire to more reliably detect whether the contact state of a terminal for storage device is excellent.

Figure 6A:
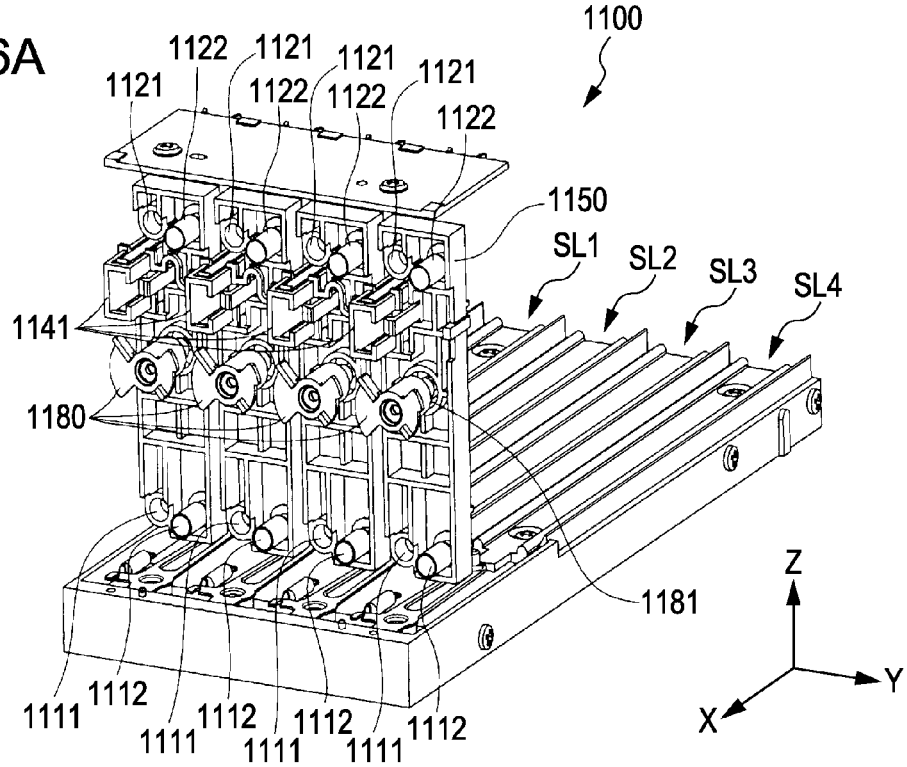
FIG. 6A is a diagram showing the configuration of a cartridge mounting section.
Figure 6B:
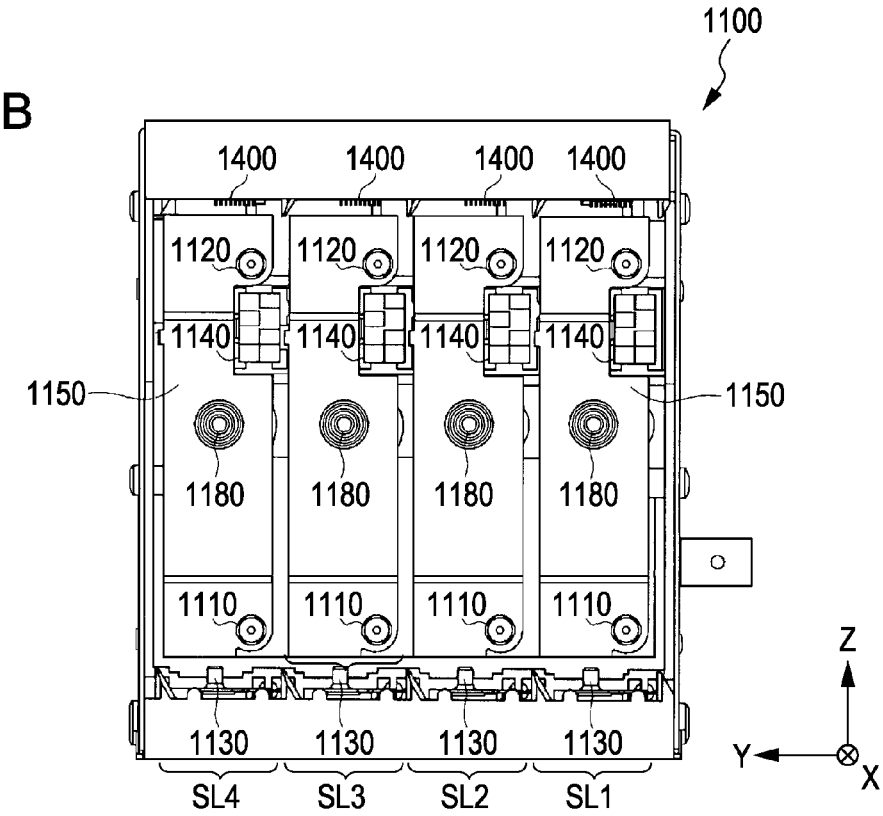
FIG. 6B is a diagram showing the configuration of the cartridge mounting section.
Figure 6C:
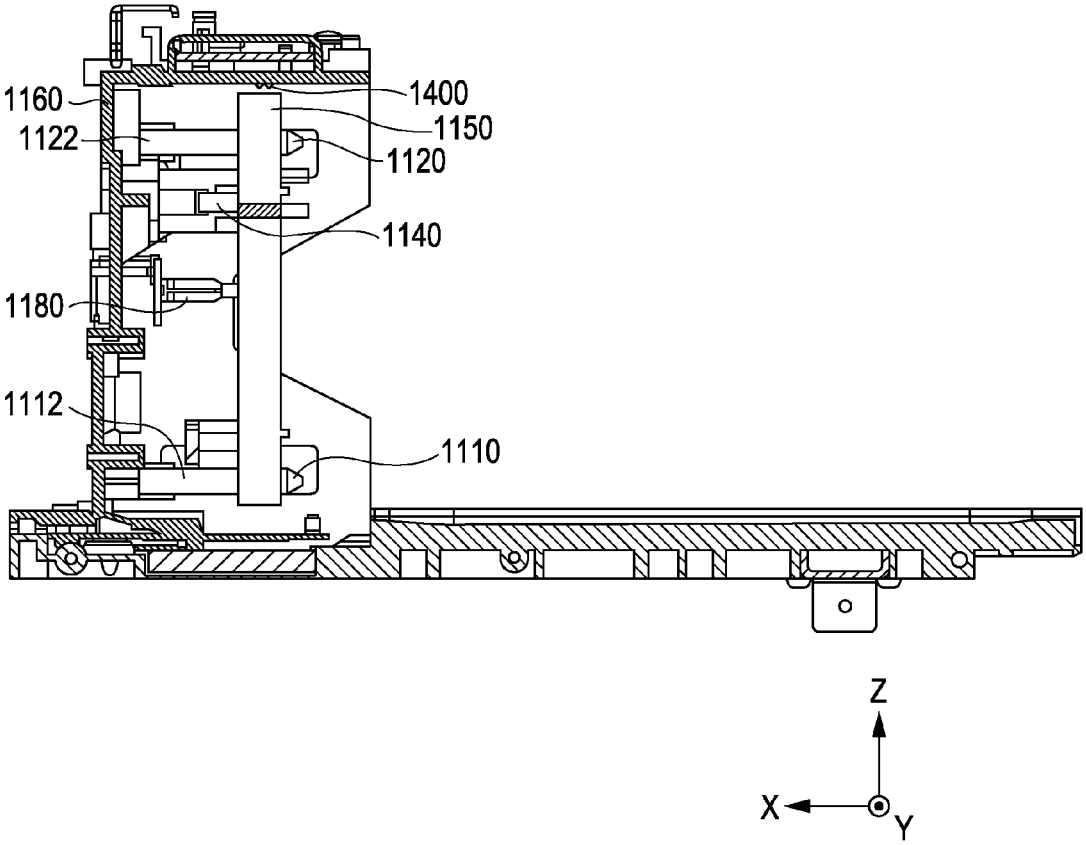
FIG. 6C is a diagram showing the configuration of the cartridge mounting section.

FIGS. 6A to 6C are diagrams showing the configuration of the cartridge mounting section 1100. FIG. 6A is a perspective view of the cartridge mounting section 1100 viewed obliquely from behind, and FIG. 6B is a diagram showing the inside of the cartridge mounting section 1100 viewed from the front (an opening for inserting the cartridge). FIG. 6C is a diagram showing the inside of the cartridge mounting section 1100 viewed from a cross-sectional surface. In addition, in FIGS. 6A to 6C, for convenience of illustration, some wall members and the like are omitted. The XYZ axes in FIGS. 6A to 6C are equivalent to the XYZ axes in FIGS. 4, 5A, and 5B. The cartridge mounting section 1100 is provided with four accommodating slots SL1 to SL4 for accommodating the cartridges. As shown in FIG. 6B, in the inside of the cartridge mounting section 1100, an ink supply tube 1180, a pair of positioning pins 1110 and 1120, a concavo-convex fitting portion 1140, and a contact mechanism 1400 are provided for each slot. As shown in FIG. 6C, the ink supply tube 1180, the pair of positioning pins 1110 and 1120, and the concavo-convex fitting portion 1140 are fixed to an inner wall member 1160 of the cartridge mounting section. The ink supply tube 1180, the positioning pins 1110 and 1120, and the concavo-convex fitting portion 1140 are inserted into through-holes 1181, 1111, 1121, and 1141 provided at a slider member 1150 and disposed to protrude in a reverse direction to the mounting direction of the cartridge. FIG. 6A is a diagram showing the slider member 1150 viewed from the rear side with the inner wall member 1160 removed. In FIG. 6A, illustration is made with the positioning pins omitted. As shown in FIG. 6A, on the rear side of the slider member 1150, a pair of biasing springs 1112 and 1122 corresponding to the pair of positioning pins 1110 and 1120 is provided. As shown in FIG. 6C, the pair of biasing springs 1112 and 1122 is disposed being fixed to the slider member 1150 and the inner wall member 1160.

The ink supply tube 1180 is used to be inserted into the ink supply port 110 (FIG. 5A) of the cartridge 100, thereby supplying ink to the printing head in the inside of the printer 1000. The positioning pins 1110 and 1120 are used to be inserted into the positioning holes 131 and 132 provided to the cartridge 100, thereby determining the accommodating position of the cartridge 100, when the cartridge 100 is inserted into the cartridge mounting section 1100. The concavo-convex fitting portion 1140 has a shape corresponding to the shape of the concavo-convex fitting portion 134 of the cartridge 100 and has a different shape for each of the accommodating slots SL1 to SL4. Accordingly, in each of the accommodating slots SL1 to SL4, only the cartridge which accommodates predetermined one type of ink can be accommodated, and the cartridge for another color cannot be accommodated.

The slider member 1150 disposed at the inner wall surface of each accommodating slot is configured so as to be able to slide in the mounting direction (the X direction) and the discharge direction (the −X direction) of the cartridge. The pair of biasing springs 1112 and 1122 (FIG. 6A) provided at each accommodating slot biases the slider member 1150 in the discharge direction. When the cartridge 100 is inserted into the accommodating slot, the cartridge 100 presses the pair of biasing springs 1112 and 1122 in the mounting direction along with the slider member 1150 and is pushed in the accommodating slot while resisting the biasing forces of the biasing springs 1112 and 1122. Therefore, in a state where the cartridge 100 has been accommodated in the cartridge mounting section 1100, the cartridge 100 is biased in the discharge direction by the pair of biasing springs 1112 and 1122. Further, in the accommodating state, a fixing member 1130 (FIG. 6B) provided at a bottom portion of each of the accommodation slots SL1 to SL4 is engaged with the fixing groove 140 (FIG. 5A) provided the bottom surface Sb of the cartridge 100. By the engagement of the fixing member 1130 with the fixing groove 140, discharge of the cartridge 100 from the cartridge mounting section 1100 by the biasing forces of the biasing springs 1112 and 1122 is prevented.

In the case of discharging the cartridge 100, once the cartridge 100 is pushed in the mounting direction by a user, in response to this, the engagement between the fixing member 1130 and the fixing groove 140 is released. As a result, the cartridge 100 is extruded in the discharge direction (the −X direction) by the biasing forces of the pair of the biasing springs 1112 and 1122. Therefore, a user can easily eject the cartridge 100 from the cartridge mounting section 1100.

The contact mechanism 1400 (FIG. 6B) has a plurality of apparatus-side terminals which come into contact with and is electrically connected to the terminals 210, 220, 230, 240, 250, 260, 270, 280, and 290 (FIGS. 1A to 1C) of the circuit substrate 200 in a case where the cartridge 100 has been mounted on the cartridge mounting section 1100. A control circuit of the printer 1000 performs transmission and receipt of a signal between the control circuit and the circuit substrate 200 through the contact mechanism 1400.

Figure 7A:
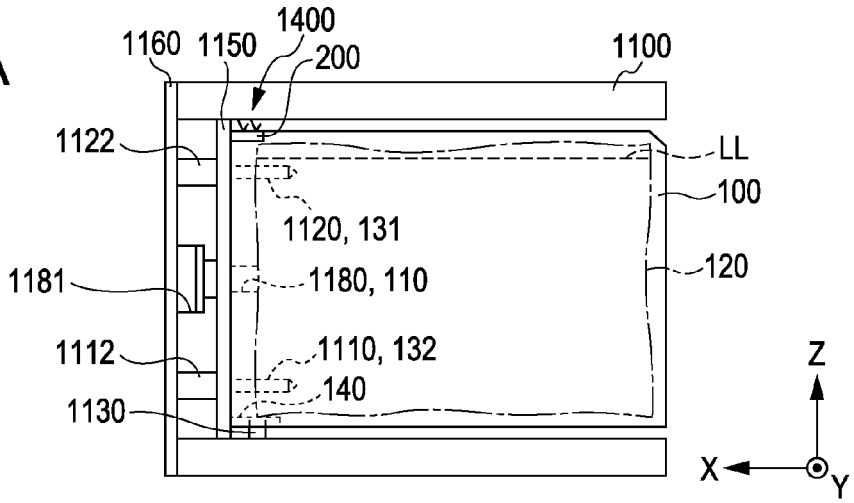
FIGS. 7A to 7C are conceptual diagrams showing states where the ink cartridge is mounted in the cartridge mounting section.

FIG. 7A shows a state where the cartridge 100 is appropriately mounted in the cartridge mounting section 1100. In this state, the cartridge 100 is in a state where the cartridge 100 is not tilted and the upper surface or the bottom surface thereof is parallel to an upper end member or a lower end member of the cartridge mounting section 1100. The ink supply tube 1180 of the cartridge mounting section 1100 is connected to the ink supply port 110 of the cartridge 100 and the positioning pins 1110 and 1120 of the cartridge mounting section 1100 are inserted into the positioning holes 131 and 132 of the cartridge 100. Further, the fixing member 1130 provided at a bottom portion of the cartridge mounting section 1100 is engaged with the fixing groove 140 provided at the bottom surface of the cartridge 100. Then, the leading end surface Sf of the cartridge is biased in the discharge direction by the pair of biasing springs 1112 and 1122 of the cartridge mounting section 1100. In a state where the cartridge 100 has been appropriately mounted, the contact mechanisms 1400 of the cartridge mounting section 1100 and the terminals 210, 220, 230, 240, 250, 260, 270, 280, and 290 (FIGS. 1A to 1C) of the substrate 200 of the cartridge 100 come into contact with each other in an excellent contact state.

Figure 7B:
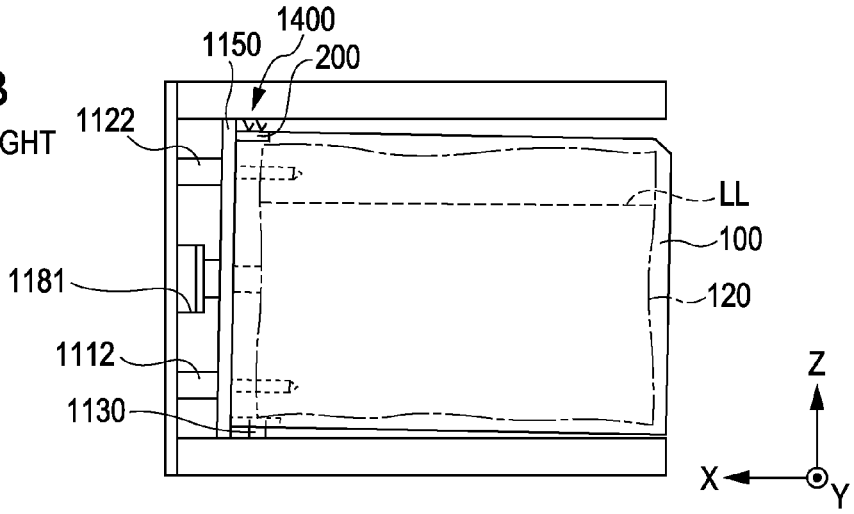
Figure 7C:
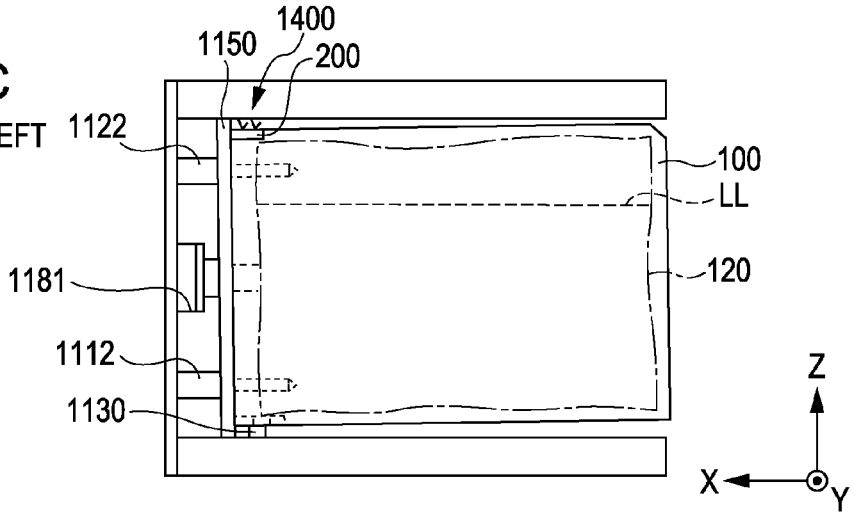

Incidentally, in the cartridge mounting section 1100, in order to facilitate mounting of the cartridge 100, some clearance is present in the inside thereof. For this reason, there is a case where the cartridge 100 is not only accommodated in an appropriate state where it is upright without being tilted, as shown in FIG. 7A, but also tilted centering around an axis parallel to the width direction (the Y direction) of the cartridge. Specifically, a case occurs where the back end of the cartridge is inclined in a slightly lowered state, as shown in FIG. 7B, or, on the contrary, the back end of the cartridge is inclined in a slightly raised state, as shown in FIG. 7C. In particular, if an ink interface LL is lowered in accordance with the consumption of ink, the center of gravity varies in accordance with a change in the weight of accommodated ink or the balance between the biasing force by the biasing springs 1112 and 1122 and the weight of the cartridge including the weight of ink varies. Then, the cartridge tends to be easily tilted in accordance with a change in the weight balance. If the cartridge is tilted, there is a possibility that poor contact may occur in some terminals among a plurality of terminals provided at the substrate 200 of the cartridge. Particularly, in the states of FIGS. 7B and 7C, there is a possibility that poor contact may occur in one or more of the terminals of one group of the group of the terminals 210, 220, 230, and 240 of the upper row R1 of the substrate 200 (FIGS. 1A to 1C) and the group of the terminals 250, 260, 270, 280, and 290 of the lower row R2.

Further, when the cartridge is tilted, there is a case where inclination in a direction perpendicular to FIGS. 7B and 7C (inclination around an axis parallel to the mounting direction X) is also generated together. At this time, the substrate 200 shown in FIGS. 1A to 1C is also tilted right and left centering around an axis parallel to the mounting direction SD thereof, so that there is a possibility that poor contact may occur in one or more of the terminals of one group of the group of the terminals 210, 220, 250, and 260 located on the left side of the substrate 200 and the group of the terminals 230, 240, 280, and 290 located on the right side.

If such poor contact occurs, trouble occurs in which it is not possible to normally perform transmission and receipt of a signal between a storage device 203 of the cartridge and the printer 1000. Further, if foreign matter such as an ink droplet or dust is attached to the vicinity of the terminal of the substrate 200, there is also a case where an unintended short circuit or a leak is generated between the terminals. In detection processing of a mounting state in various embodiments which are described below, the processing is executed in order to detect poor contact caused by such an inclination of the cartridge or detect the unintended short circuit or the leak caused by the foreign matter.

Incidentally, the cartridge for the large format ink jet printer has the following characteristic points, compared to the cartridge for the small ink jet printer for individuals.

(1) The dimensions of the cartridge are large (the length L1 is 100 mm or more).

(2) The amount of accommodated ink is large (17 ml or more, typically, 100 ml or more).

(3) The cartridge is mechanically connected at the leading end surface (the surface of a head in the mounting direction) thereof to the cartridge mounting section.

(4) A space in the ink accommodating chamber is not partitioned and configures a single ink accommodating chamber (ink accommodating bag).

According to the type of large format ink jet printer, a cartridge which does not have some of these characteristic points (1) to (4) is also used. However, the cartridge usually has at least one characteristic point of these.

Since the cartridge for the large format ink jet printer has such a dimension, weight, a connection position to the cartridge mounting section, or a characteristic point of the configuration of an ink chamber, compared to the cartridge for the small ink jet printer, the cartridge is apt to be tilted, and as a result, poor contact in the terminal of the substrate 200 tends to be easily generated. Therefore, it is considered that particularly, with respect to the large format ink jet printer and the cartridge thereof, performing the detection processing of poor contact of the terminal, an unintended short circuit, a leak, or the like, as described below, is of great significance.

Figure 8:
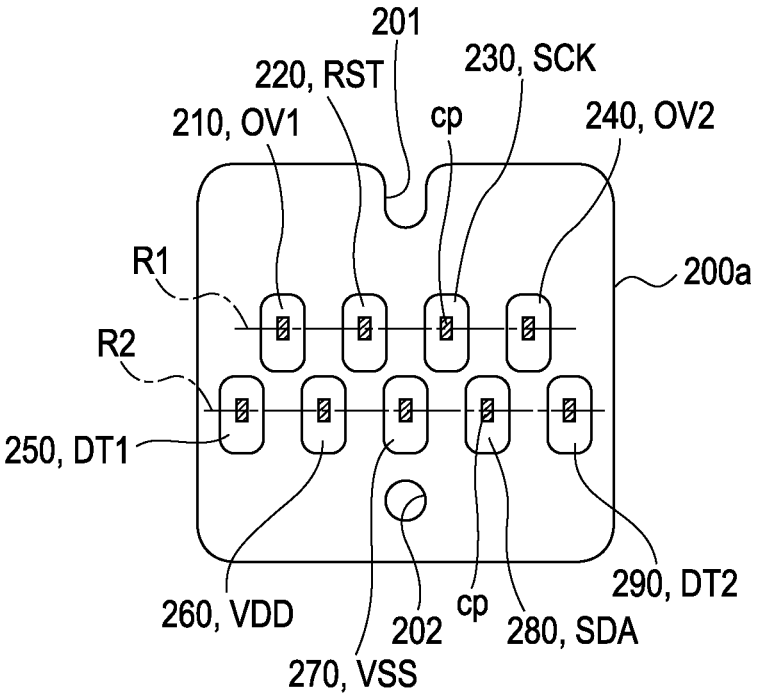
FIG. 8 is a diagram showing the configuration of the substrate in the first embodiment of the printing system.

FIG. 8 is diagram showing the configuration of a substrate 200*a* in the first embodiment of the printing system. The array of the terminals 210, 220, 230, 240, 250, 260, 270, 280, and 290 is the same as that shown in FIG. 1A. However, the function (use) of each terminal is as follows and is slightly different from that in the embodiment shown in FIG. 1A.

The upper row R1

(1) Overvoltage detection terminal 210 (also used for leak detection and mounting detection)

(2) Reset terminal 220

(3) Clock terminal 230

(4) Overvoltage detection terminal 240 (also used for leak detection and mounting detection)

The lower row R2

(5) Sensor terminal 250 (also used for mounting detection)

(6) Power supply terminal 260

(7) Earth terminal 270

(8) Data terminal 280

(9) Sensor terminal 290 (also used for mounting detection)

The terminals 210 and 240 located at both ends of the upper row R1 and the contact portions thereof are used for detection of overvoltage (described later), leak detection between the terminals (described later), and mounting detection (contact detection). Further, the terminals 250 and 290 of the lower row R2 and the contact portions thereof are used for both detection of the amount of ink remaining using a sensor provided in the cartridge 100 and mounting detection (contact detection). In addition, four contact portions of the terminals 210, 240, 250, and 290 located at four corner of a rectangular area which includes the contact portions of the group of the terminals 210, 220, 230, 240, 250, 260, 270, 280, and 290 are used for mounting detection (contact detection) (described later). In addition, in the first embodiment of the printing system, to the contact portions of the two terminals 210 and 240 disposed at both ends of the upper row R1, the same voltage as a first power-supply voltage VDD (described later)

for driving the storage device, or voltage generated from the first power-supply voltage VDD is applied, and to the contact portions of the two terminals 250 and 290 disposed at both ends of the lower row R2, the same voltage as a second power-supply voltage VHV (described later) which is used to drive the printing head, or voltage generated from the second power-supply voltage VHV is applied. Here, as "the voltage generated from the second power-supply voltage VHV", it is preferable to use voltage higher than the first power-supply voltage VDD and lower than the second power-supply voltage VHV.

Incidentally, as one aspect of the mounting state or the contact detection of the printing material cartridge, there is a case where short-circuit detection of examining whether or not an unintended short circuit has been generated between the terminals of the cartridge is performed. In short-circuit detection, for example, a terminal for short circuit detection is provided at a position adjacent to a terminal for high voltage to which voltage higher than a normal power-supply voltage (3.3 V) is applied, and whether or not excess voltage is generated in the terminal for short circuit detection can be examined. Then, in a case where excess voltage has been detected at the terminal for short circuit detection, application of high voltage to the terminal for high voltage is stopped. However, even if application of high voltage is immediately stopped when excess voltage has been generated in the terminal for short circuit detection, there is a problem in which a possibility that some sort of trouble may be generated in the cartridge or the printer due to the excess voltage generated before the stop cannot be denied. The first embodiment of the printing system or a second embodiment of the printing system, which is described below, also includes devisal for solving such a problem in the past.

Figure 9:
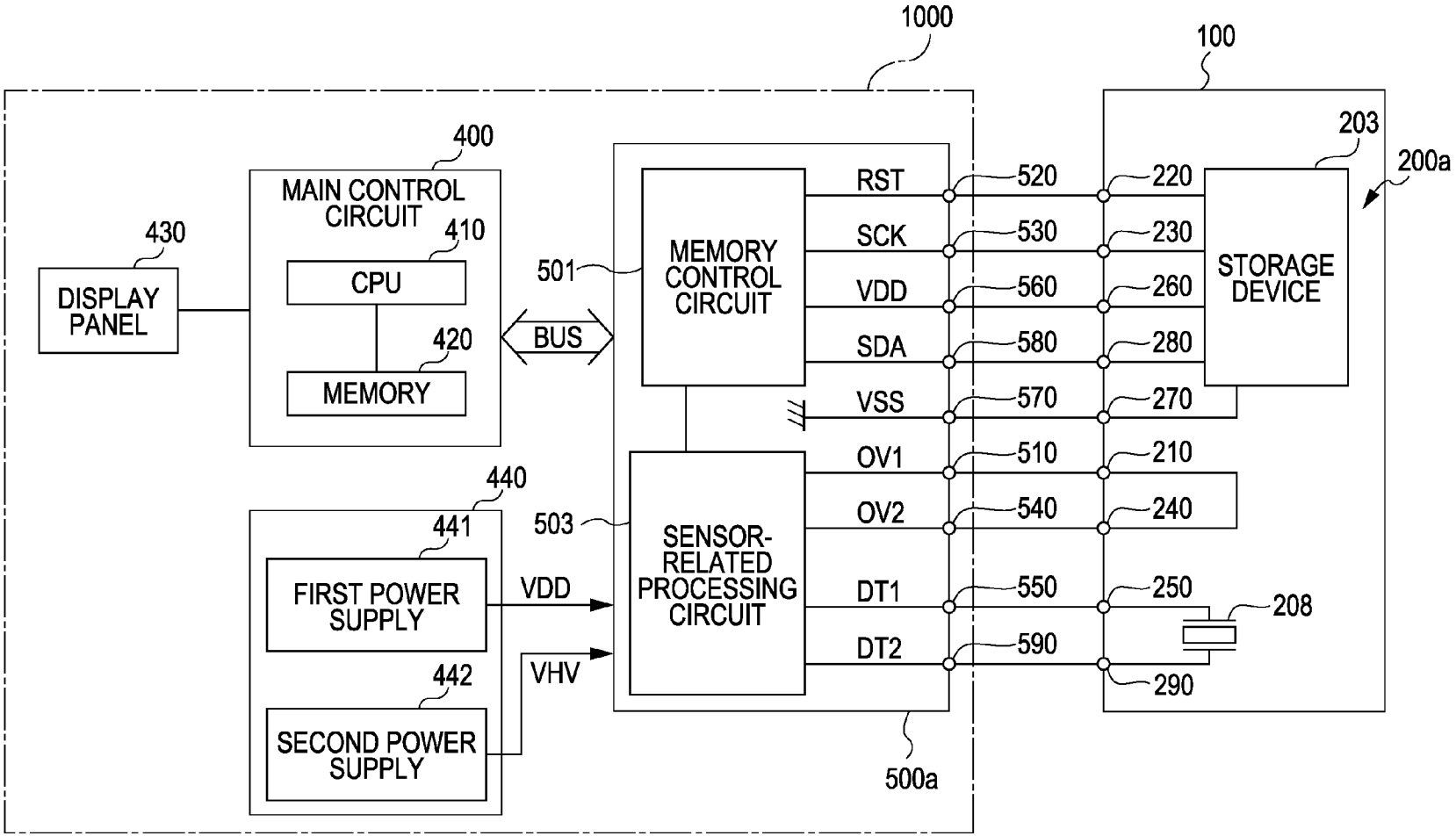
FIG. 9 is a block diagram showing the electrical configurations of the substrate of the ink cartridge and the printer in the first embodiment of the printing system.

FIG. 9 is a block diagram showing the electrical configurations of the substrate 200*a* of the cartridge in the first embodiment and the printer 1000. The printer 1000 includes a display panel 430, a power circuit 440, a main control circuit 400, and a sub-control circuit 500*a*. The display panel 430 is a display section for giving a user various notices such as the operating state of the printer 1000 or the mounting state of the cartridge. The display panel 430 is provided in, for example, the operating section 1300 in FIG. 4. The power circuit 440 includes a first power supply 441 which generates the first power-supply voltage VDD and a second power supply 442 which generates the second power-supply voltage VHV. The first power-supply voltage VDD is a normal power-supply voltage (rating 3.3 V) which is used in a logic circuit. The second power-supply voltage VHV is high voltage (for example, rating 42 V) which is used to drive the printing head, thereby discharging ink. These voltages VDD and VHV are supplied to the sub-control circuit 500*a* and also supplied to other circuits as necessary. In addition, it is also possible to refer to a circuit which includes the main control circuit 400 and the sub-control circuit 500*a* as a "control circuit".

The reset terminal 220, the clock terminal 230, the power supply terminal 260, the earth terminal 270, and the data terminal 280 among nine terminals provided at the substrate 200*a* (FIG. 8) of the cartridge are electrically connected to the storage device 203. The storage device 203 is a nonvolatile memory which has no address terminal, in which a memory cell performing access on the basis of the pulse number of a clock signal SCK which is input from the clock terminal and command data which is input from the data terminal is determined, and which receives data from the data terminal or transmits data from the data terminal, in synchronization with the clock signal SCK. The clock terminal 230 is used to supply the clock signal SCK from the sub-control circuit 500*a* to the storage device 203. Power-supply voltage (for example, rating 3.3 V) for driving the storage device and earth voltage (0 V) are respectively supplied from the printer 1000 to the power supply terminal 260 and the earth terminal 270. The power-supply voltage for driving the storage device 203 may also be voltage which is directly given from the first power-supply voltage VDD, or voltage which is generated from the first power-supply voltage VDD and is lower than the first power-supply voltage VDD. The data terminal 280 is used to exchange a data signal SDA between the sub-control circuit 500*a* and the storage device 203. The reset terminal 220 is used to supply a reset signal RST from the sub-control circuit 500*a* to the storage device 203. The two overvoltage detection terminals 210 and 240 are connected to each other through a wiring in the substrate 200*a* (FIG. 8) of the cartridge 100. In addition, although in the example of FIG. 9, the two overvoltage detection terminals 210 and 240 are connected to each other by a wiring, a portion of the wiring connecting these may also be replaced with a resistor. In addition, a state where two terminals are connected to each other by a wiring is also referred to as "short-circuit connection" or "conductive wire connection". Short-circuit connection by a wiring is a state different from an unintended short circuit.

In FIG. 9, wiring names SCK, VDD, SDA, RST, OV1, OV2, DT1, and DT2 are given to wiring pathways which connects apparatus-side terminals 510, 520, 530, 540, 550, 560, 570, 580, and 590 and the terminals 210, 220, 230, 240, 250, 260, 270, 280, and 290 of the substrate 200*a*. Among these wiring names, with respect to the wiring names of the wiring pathways for the storage device, the same names as signal names are used. In addition, the apparatus-side terminals 510, 520, 530, 540, 550, 560, 570, 580, and 590 are provided to the contact mechanisms 1400 shown in FIGS. 6B, and 7A to 7C.

The substrate 200*a* includes a sensor 208 which is used for detection of the amount of ink remaining, in addition to the storage device 203 and the nine terminals 210, 220, 230, 240, 250, 260, 270, 280, and 290. As the sensor 208, it is possible to use a well-known ink remaining amount sensor using, for example, a piezoelectric element. In addition, the piezoelectric element electrically functions as a capacitive element.

The main control circuit 400 includes a CPU 410 and a memory 420. The sub-control circuit 500*a* includes a memory control circuit 501 and a sensor-related processing circuit 503. The sensor-related processing circuit 503 is a circuit for performing detection of the mounting state of the cartridge in the cartridge mounting section 1100 and detection of the amount of ink remaining using the sensor 208. Since the sensor-related processing circuit 503 is used to perform detection of the mounting state of the cartridge, it is also possible to refer to the sensor-related processing circuit 503 as a "mounting detection circuit". The sensor-related processing circuit 503 is a high-voltage circuit which applies or supplies voltage high compared to the power-supply voltage VDD which is applied or supplied to the storage device 203, to the sensor 208 of the cartridge. In addition, as high voltage which is applied to the sensor 208, it is possible to use the power-supply voltage VHV (rating 42 V) itself which is used for driving of the printing head, or use a slightly low voltage (for example, 36 V) generated from the power-supply voltage VHV which is used for driving of the printing head.

Figure 10:
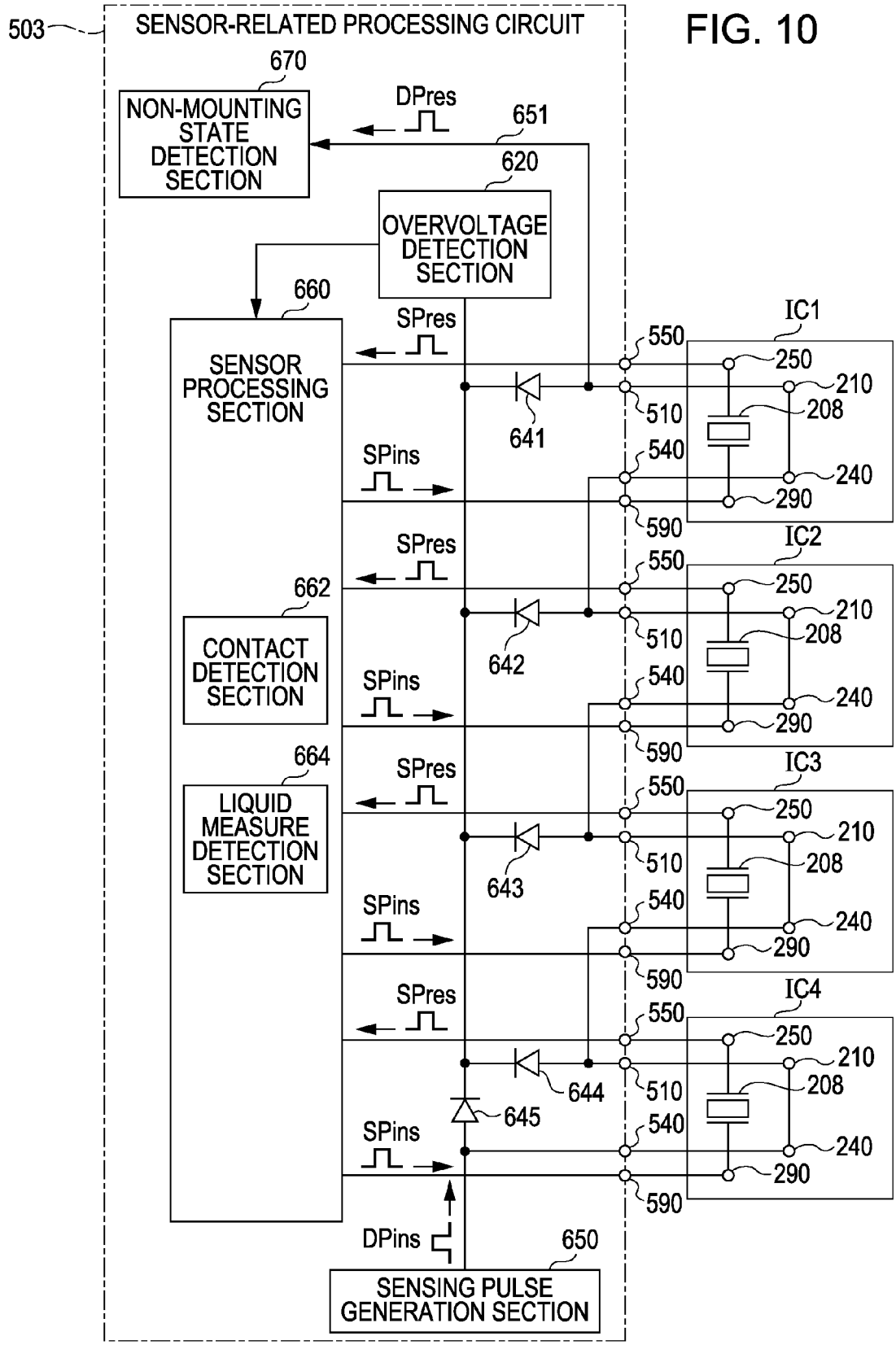
FIG. 10 is a diagram showing the internal configurations of a sensor-related processing circuit in the first embodiment of the printing system.

FIG. 10 is a diagram showing the internal configuration of the sensor-related processing circuit 503 in the first embodiment of the printing system. Here, a state where four cartridges are mounted on the cartridge mounting section is shown, and reference numerals IC1 to IC4 are used to distinguish the respective cartridges. The sensor-related processing circuit 503 includes a non-mounting state detection section 670, an overvoltage detection section 620, a sensing pulse generation section 650, and a sensor processing section 660. The sensor processing section 660 includes a contact detection section 662 and a liquid measure detection section 664. The contact detection section 662 performs detection of the contact states of the sensor terminals 250 and 290 with use of the sensor 208 of the cartridge. The liquid measure detection section 664 performs detection of the amount of ink remaining with use of the sensor 208 of the cartridge. The sensing pulse generation section 650 and the non-mounting state detection section 670 perform detection (detection processing of a non-mounting state) of whether or not all the cartridges have been mounted and detection of leak states between the terminals 210/250 and between the terminals 240/290. The overvoltage detection section 620 performs detection of whether or not excessive voltage is applied to the overvoltage detection terminals 210 and 240.

In the inside of each cartridge, the first and second overvoltage detection terminals 210 and 240 are connected to each other through a wiring. Although in the example of FIG. 10, the overvoltage detection terminals 210 and 240 are short-circuited and connected to each other by a wiring, a portion of the connection wiring may also be made as a resistor. The first overvoltage detection terminal 210 of the first cartridge IC1 is connected to a wiring 651 in the sensor-related processing circuit 503 through a corresponding apparatus-side terminal 510 and the wiring 651 is connected to the non-mounting state detection section 670. The second overvoltage detection terminal 240 of the n-th (n=1 to 3) cartridge and the first overvoltage detection terminal 210 of the (n+1)th cartridge are connected to each other through corresponding apparatus-side terminals 540 and 510. Further, the second overvoltage detection terminal 240 of the fourth cartridge IC4 is connected to the sensing pulse generation section 650 through a corresponding apparatus-side terminal 540. If all the cartridges IC1 to IC4 are correctly mounted in the cartridge mounting section, the sensing pulse generation section 650 and the non-mounting state detection section 670 are connected to each other by sequentially going through the overvoltage detection terminals 240 and 210 of the respective cartridges. On the other hand, in a case where even one cartridge is not mounted or a case where there is poor mounting, non-contact or poor contact occurs in either the apparatus-side terminals 510 and 540 or the terminals 210 and 240 of the cartridges IC1 to IC4, so that the sensing pulse generation section 650 and the non-mounting state detection section 670 enter into a non-connection state. Therefore, the non-mounting state detection section 670 can determine whether or not non-contact or poor contact is present in any of the overvoltage detection terminals 210 and 240 of the cartridges IC1 to IC4, in accordance with whether or not the non-mounting state detection section 670 can receive a response signal DPres corresponding to an inspection signal DPins which is sent from the sensing pulse generation section 650. In this manner, in the first embodiment of the printing system, when all the cartridges IC1 to IC4 have been mounted in the cartridge mounting section, since the overvoltage detection terminals 210 and 240 of each cartridge are sequentially connected in series, by examining the connection state, it is possible to determine whether or not non-contact or poor contact is present in any of the overvoltage detection terminals 210 and 240 of the cartridges IC1 to IC4. A typical case where such non-contact or poor contact occurs is a case where one or more of the cartridges are not mounted. Therefore, the non-mounting state detection section 670 can immediately determine whether or not one or more of the cartridges are not mounted, in accordance with whether or not the non-mounting state detection section 670 can receive the response signal DPres corresponding to the inspection signal DPins. It is acceptable if the inspection signal DPins is generated on the basis of voltage which is supplied form the first power-supply voltage VDD.

The first overvoltage detection terminals 210 of the four cartridges IC1 to IC4 are connected to anode terminals of diodes 641 to 644 through the corresponding apparatus-side terminals 510. Further, the second overvoltage detection terminals 240 of the four cartridges IC1 to IC4 are connected to anode terminals of diodes 642 to 645 through the corresponding apparatus-side terminals 540. In addition, the anode terminal of the second diode 642 is connected in common to the second overvoltage detection terminal 240 of the first cartridge IC1 and the first overvoltage detection terminal 210 of the second cartridge IC2. The diodes 643 and 644 are also similarly connected in common to the second overvoltage detection terminal 240 of one cartridge and the first overvoltage detection terminal 210 of the adjacent cartridge. The anode terminals of these diodes 641 to 645 are connected in parallel to the overvoltage detection section 620. These diodes 641 to 645 are used to monitor whether or not abnormal high voltage is not applied to the overvoltage detection terminals 210 and 240. Such an abnormal voltage value (referred to as "overvoltage") is generated in a case where an unintended short circuit is generated between any of the overvoltage detection terminals 210 and 240 of each cartridge and any of the sensor terminals 250 and 290. For example, if foreign matter such as an ink droplet or dust is attached to the surface of the substrate 200*a* (FIG. 8), there is a possibility that an unintended short circuit may be generated between the first overvoltage detection terminal 210 and the first sensor terminal 250 or between the second overvoltage detection terminal 240 and the second sensor terminal 290. If such an unintended short circuit is generated, since an electric current flows to the overvoltage detection section 620 through any of the diodes 641 to 645, the overvoltage detection section 620 can determine the presence or absence of generation of overvoltage and the presence or absence of generation of an unintended short circuit. Further, in general, foreign matter that causes an unintended short circuit is apt to enter from above to below the substrate 200 and from the outside toward the inside. Therefore, if the contact portions of the overvoltage detection terminals 210 and 240 are disposed so as to become the contact portions of both ends (FIG. 8) of the contact portions which are disposed on the upper row R1 of the substrate 200, since the overvoltage detection terminals 210 and 240 are disposed close to the sensor terminals 250 and 290, it is possible to reduce a possibility that high voltage which is applied to the sensor terminals 250 and 290 may be applied to the memory terminals 220, 230, 260, 270, and 280.

Figure 11:
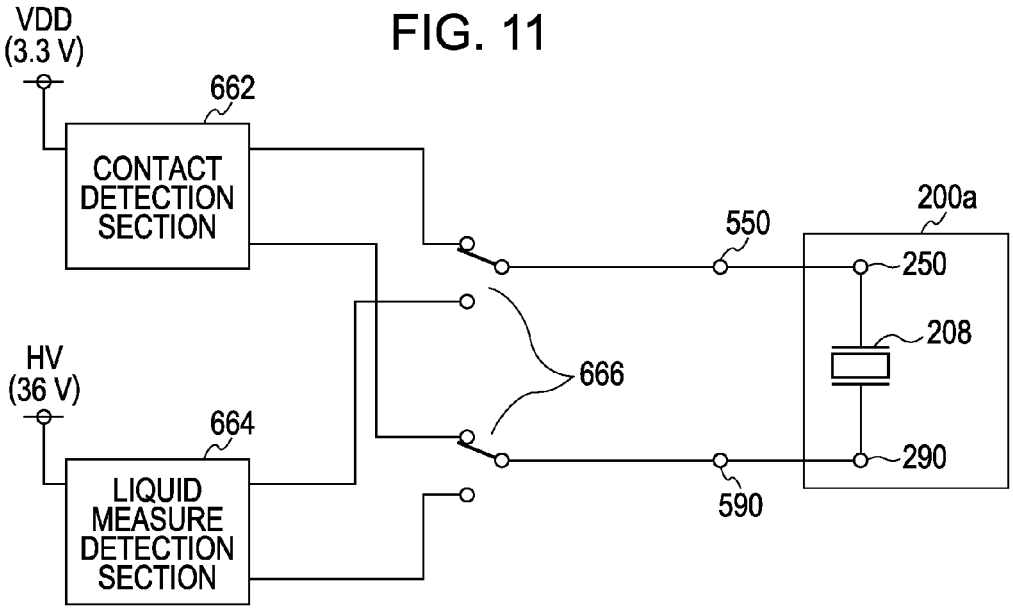
FIG. 11 is a block diagram showing the connection state of a contact detection section and a liquid measure detection section with a sensor of the cartridge in the first embodiment of the printing system.

FIG. 11 is a block diagram showing a connection state of the contact detection section 662 and the liquid measure detection section 664 to the sensor 208 of the cartridge. The sensor 208 is selectively connected to one of the contact detection section 662 and the liquid measure detection section 664 through a change-over switch 666. In a state where the sensor 208 has been connected to the contact detection section 662, the contact detection section 662 detects whether or not the sensor terminals 250 and 290 and the apparatus-side terminals 550 and 590 corresponding to these are in excellent contact states. On the other hand, in a state where the sensor 208 has been connected to the liquid measure detection section 664, the liquid measure detection section 664 detects whether or not the amount of ink remaining in the cartridge is equal to or more than a predetermined amount. The contact detection section 662 is operated using relatively low power-supply voltage VDD (for example, 3.3 V). On the other hand, the liquid measure detection section 664 is operated using relatively high power-supply voltage HV (for example, 36 V).

In addition, the contact detection section 662 and the liquid measure detection section 664 may also be individually provided for each individual cartridge, or one contact detection section 662 and one liquid measure detection section 664 may also be provided in common at a plurality of cartridges. In the latter case, change-over switches for switching the connection states of the sensor terminals 250 and 290 of the individual cartridge and the contact detection section 662 and the liquid measure detection section 664 are further provided.

Figure 12:
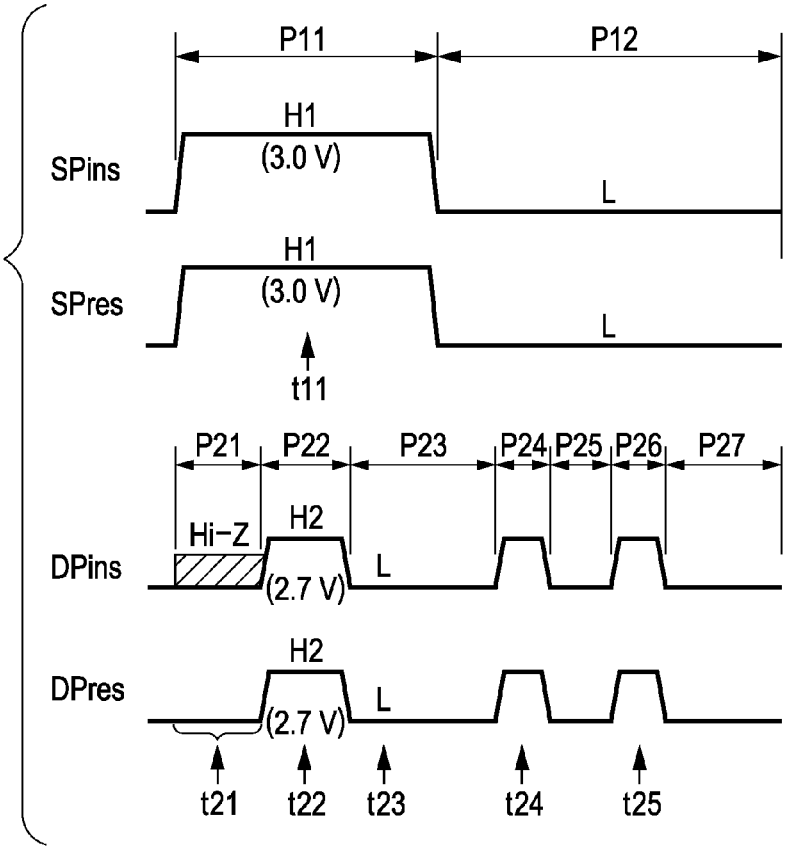
FIG. 12 is a timing chart showing various signals which are used in mounting detection processing.

FIG. 12 is a timing chart showing various signals which are used for cartridge mounting detection processing (also referred to as "contact detection processing") in the first embodiment of the printing system. In the cartridge mounting detection processing, first mounting detection signals SPins and SPres and second mounting detection signals DPins and DPres are used. In addition, the signals SPins and DPins in which "ins" is added to the end of the signal name are signals which are output from the sensor-related processing circuit 503 to the substrate 200 of the cartridge and are referred to as "mounting inspection signals". Further, the signals SPres and DPres in which "res" is added to the end of the signal name are signals which is input from the substrate 200 of the cartridge to the sensor-related processing circuit 503 and are referred to as "mounting response signals".

As shown below, in the first embodiment of the printing system, the following three types of mounting state detection processing are carried out.

(1) First mounting detection processing: detection of the contact states of the sensor terminals 250 and 290 of the individual cartridge using the first mounting detection signals SPins and SPres.

(2) Second mounting detection processing: detection of the non-mounting states of one or more of the cartridges (detection of the contact states of the overvoltage detection terminals 210 and 240 of all the cartridges) using the second mounting detection signals DPins and DPres.

(3) Leak detection processing: detection of the leak states between the terminals 210/250 and between the terminals 240/290 using the second mounting detection signals DPins and DPres.

Since in the first and second mounting detection processing, the contact states of the terminals are detected, it is also possible to refer to these processing as "contact detection processing". Further, it is also possible to refer to the first and second mounting detection signals as "first contact detection signals SPins and SPres" and "second contact detection signals DPins and DPres".

The first mounting detection signals SPins and SPres are used in order for the contact detection section 662 to detect the contact states of the sensor terminals 250 and 290 of the individual cartridge. As shown in FIG. 10, the first mounting inspection signal SPins is a signal which is supplied from the contact detection section 662 to the sensor terminal 290 on one side and the first mounting response signal SPres is a signal which returns from the sensor terminal 250 on the other side to the contact detection section 662. The first contact inspection signal SPins is a signal which becomes a high level H1 in a first period P11 in FIG. 12 and becomes a low level in a subsequent second period P12. In addition, the voltage of the high level H1 of the first mounting inspection signal SPins is set to be, for example, 3.0 V. In a case where both the terminals 250 and 290 are in a normal contact state, the first mounting response signal SPres presents the same level change as that in the first mounting inspection signal SPins.

The second mounting inspection signal DPins is a signal which is supplied from the sensing pulse generation section 650 to the overvoltage detection terminal 240 of the fourth cartridge IC4, as shown in FIG. 10, and the second mounting response signal DPres is a signal which is input from the overvoltage detection terminal 210 of the first cartridge IC1 to the non-mounting state detection section 670. As shown in FIG. 12, the second mounting inspection signal DPins is divided into seven periods P21 to P27. That is, the second mounting inspection signal DPins enters into a high impedance state in the period P21, becomes a high level H2 in the periods P22, P24, and P26, and becomes a low level in other periods P23, P25, and P27. The voltage of the high level H2 of the second mounting inspection signal DPins is set to be 2.7 V and set to be a voltage level different from the high level H1 (3.0 V) of the first mounting inspection signal SPins. In addition, the first and second periods P21 and P22 of the second mounting inspection signal DPins are equivalent to a portion of the first period P11 of the first mounting inspection signal SPins. Further, the fourth to seventh periods P24 to P27 of the second mounting inspection signal DPins are equivalent to a portion of the second period P12 of the first mounting inspection signal SPins. In a case where the terminals 210 and 240 of all the cartridges are in a normal contact state, the second mounting response signal DPres becomes a signal which becomes a low level in the first period P21 and presents the same levels as those in the second mounting inspection signal DPins in the second period P22 or later. In addition, the reason that the second mounting response signal DPres becomes a low level in the first period P21 is because the second mounting response signal DPres (that is, the input wiring 651 to the non-mounting state detection section 670) has become a low level in a state immediately before the first period P21.

Figure 13A:
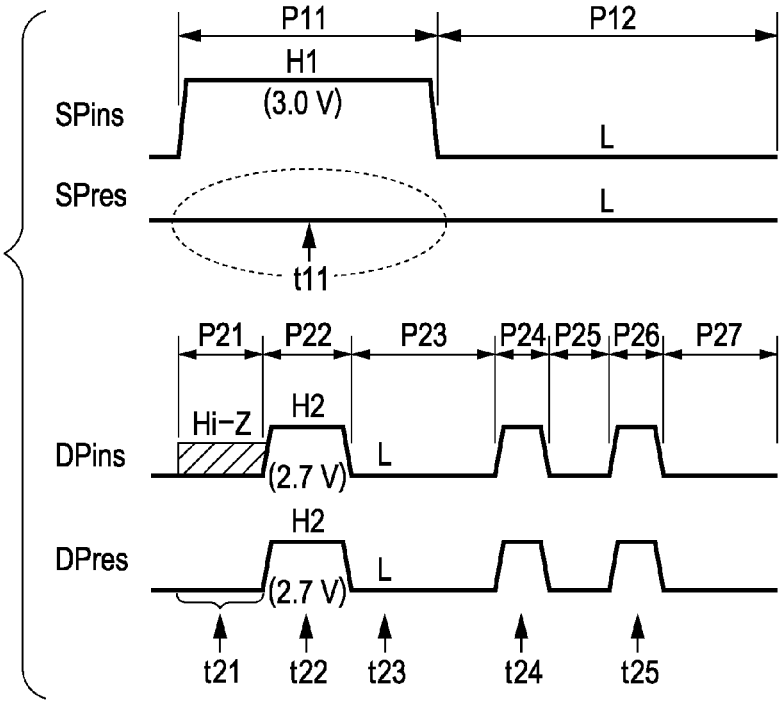
FIGS. 13A and 13B are timing charts showing typical signal waveforms in a case where there is poor contact.

FIG. 13A shows signal waveforms in a case where contact of at least one of the terminals 250 and 290 is poor. In this case, the first mounting response signal SPres becomes a low level through the periods P11 and P12. The contact detection section 662 can determine good or bad of contact of the terminals 250 and 290 by examining the level of the mounting response signal SPres at a predetermined timing t11 in the period P11. In a case where the cartridge in which poor contact is present in the terminals 250 and 290 has been detected, it is preferable that the main control circuit 400 display the information (characters or an image) indicating the effect that the mounting state of the cartridge is poor, on the display panel 430, thereby giving notice to a user.

Figure 13B:
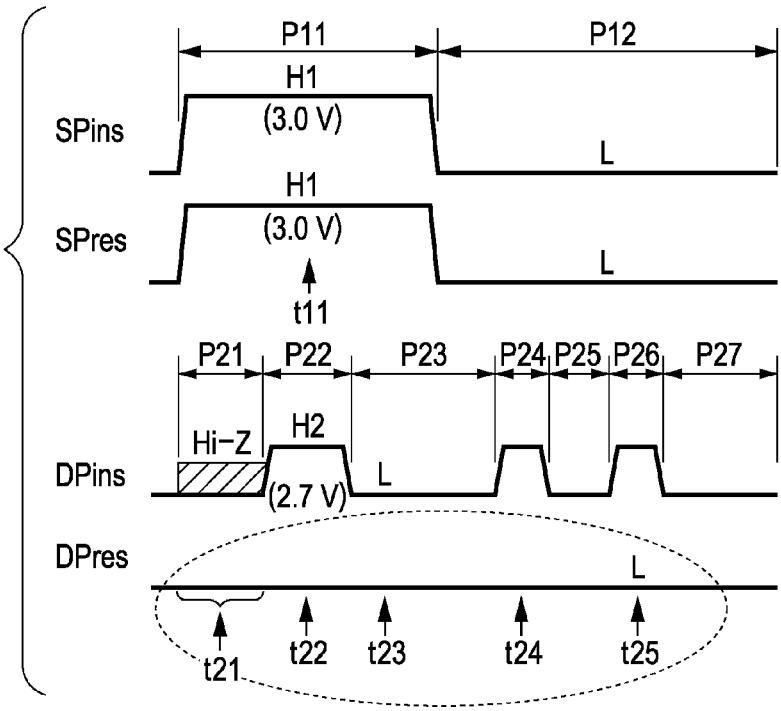

FIG. 13B shows signal waveforms in a case where at least one terminal of the terminals 210 and 240 of all the cartridges is in poor contact. In this case, the second mounting response signal DPres becomes a low level through the periods P21 to P27. Therefore, the non-mounting state detection section 670 can detect a state where one or more of the cartridges are not normally mounted, by examining the level of the second mounting response signal DPres at preset timings t22, t24, and t25 of the periods P22, P24, and P26 in which the second mounting inspection signal DPins becomes a high level. In addition, it is sufficient if the determination is performed at least one timing of the three timings t22, t24, and t25. In a case where it is determined that one or more of the cartridges are not normally mounted, it is preferable that the main control circuit 400 display the information (characters or an image) indicating the effect that the mounting state is poor, on the display panel 430, thereby giving notice to a user.

If it is aimed only at the above-described non-mounting state detection processing (the second mounting detection processing), the second mounting inspection signal DPins may also be set to be a simple pulse signal similar to the first mounting inspection signal SPins. The reason that the second mounting inspection signal DPins has a complicated waveform shape as in FIG. 12 is mainly for detection of a leak state (the third mounting state detection processing) which is described below.

Figure 14A:
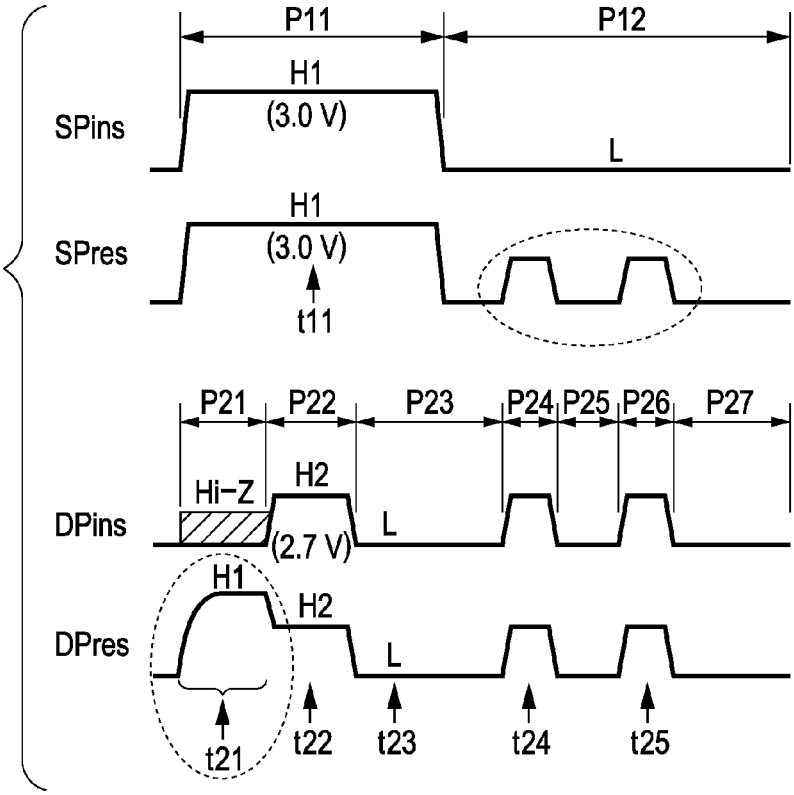
FIGS. 14A and 14B are timing charts showing typical signal waveforms in a case where the overvoltage detection terminal and a sensor terminal are in a leak state.

FIG. 14A shows signal waveforms in a case where a leak state is created between the overvoltage detection terminal 240 and the sensor terminal 290. Here, the "leak state" means a state which is not an extremely-low resistance state enough to say an unintended short circuit and in which the terminals are connected to each other with a certain degree or less of a resistance value (for example, a resistance value of 10 kΩ or less). In this case, the second mounting response signal DPres presents a distinctive signal waveform. That is, the second mounting response signal DPres rises from a low level to the first high level H1 in the first period P21 and is lowered to the second high level H2 in the second period P22. The first high level H1 is approximately the same voltage as the high level H1 of the first mounting inspection signal SPins. Such a waveform can be understood from an equivalent circuit which is described below.

Figure 15A:
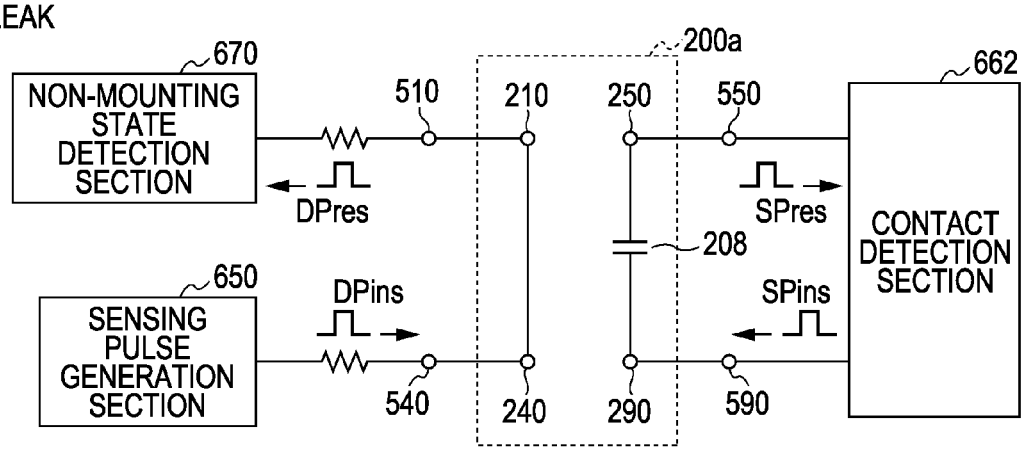
FIGS. 15A to 15C are diagrams showing equivalent circuits in the connection state of the substrate, the contact detection section, a sensing pulse generation section, and a non-contact state detection section.
Figure 15B:
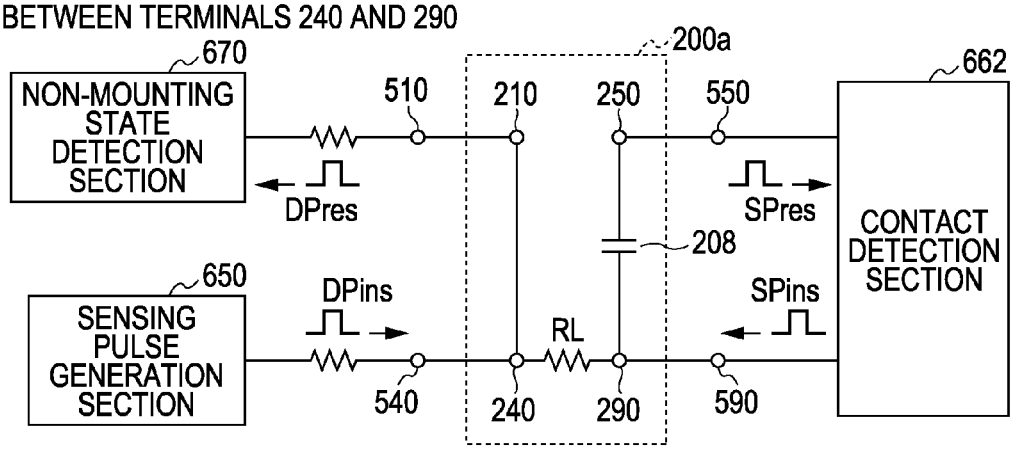

FIG. 15A shows the connection relationship of the substrate 200*a*, the contact detection section 662, the sensing pulse generation section 650, and the non-mounting state detection section 670. This state is a state where there is no leak between adjacent terminals. FIG. 15B shows an equivalent circuit in a case where a leak is present between the terminals 240 and 290. Here, a leak state between the terminals 240 and 290 is simulated by a resistance RL. The sensor 208 has a function as a capacitive element. A circuit which includes the capacity of the sensor 208 and the resistance RL between the terminals 240 and 290 in FIG. 15B functions as a low-pass filter circuit (an integrating circuit) with respect to the first contact inspection signal SPins. Therefore, the second mounting response signal DPres which is input to the non-mounting state detection section 670 becomes a signal which gradually rises up to the high level H1 (about 3 V) of the first mounting inspection signal SPins, as shown in FIG. 14A. The non-mounting state detection section 670 can identify the presence of a leak between the terminals 240 and 290 by examining the voltage level of the second mounting response signal DPres at one or more (preferably, a plurality) of the timings t21 in the period P21. Or, it is also possible to determine that a leak is present between the terminals 240/290, from a difference in voltage between the high levels H1 and H2 of the second mounting response signal DPres in the first and second periods P21 and P22 of the second mounting response signal DPres.

In addition, a change in the second mounting response signal DPres in the first period P21 in FIG. 14A is also obtained when the level of the second mounting inspection signal DPins in the period P21 is set to be a level lower than the first high level H1. Therefore, for example, even if the second mounting inspection signal DPins is set to be maintained at a low level in the period P21, it is possible to detect a leak state between the terminals 240 and 290. Further, the second mounting inspection signal DPins may also be set to be maintained at a low level over the periods P21 to P23.

In a case where a leak is present between the terminals 240 and 290, the first mounting response signal SPres presents a distinctive change. That is, the first mounting response signal SPres rises depending on rise of the second mounting inspection signal DPins to a high level, in the periods P24 and P26. Therefore, also by examining the first mounting response signal SPres at the given timing t24 and t25 of these periods P24 and P26, it is possible to determine whether or not a leak is generated.

Figure 14B:
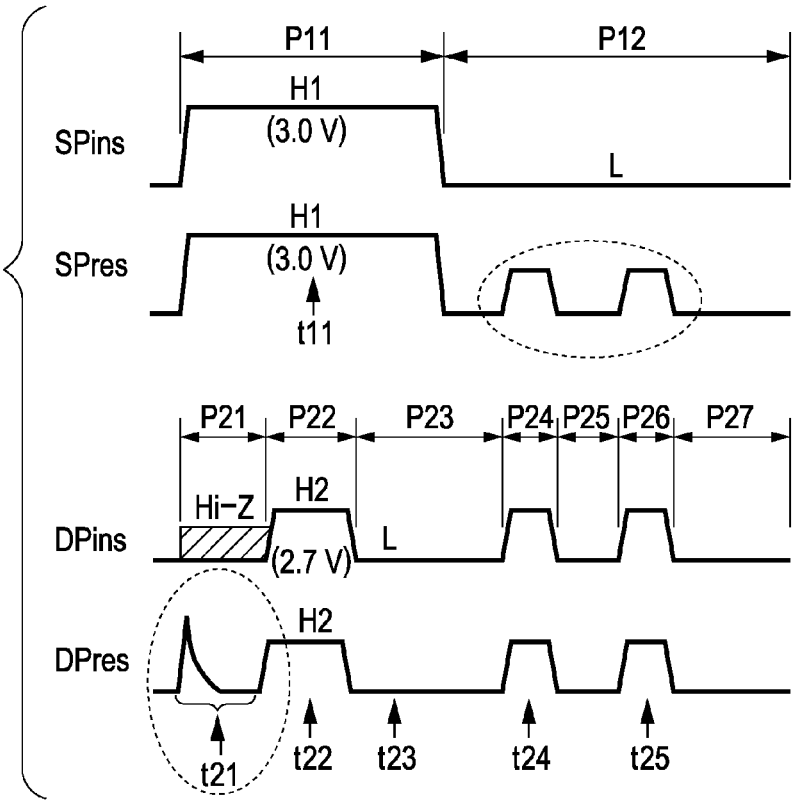

FIG. 14B shows signal waveforms in a case where a leak state is created between another overvoltage detection terminal 210 and the sensor terminal 250. Also in this case, the second mounting response signal DPres presents a distinctive signal waveform. That is, the second mounting response signal DPres rapidly rises from a low level and then is somewhat gently lowered, in the first period P21. The voltage level of a leak at this time is higher than the high level H2 of the second mounting inspection signal DPins and reaches a level close to the high level H1 of the first mounting inspection signal SPins.

Figure 15C:
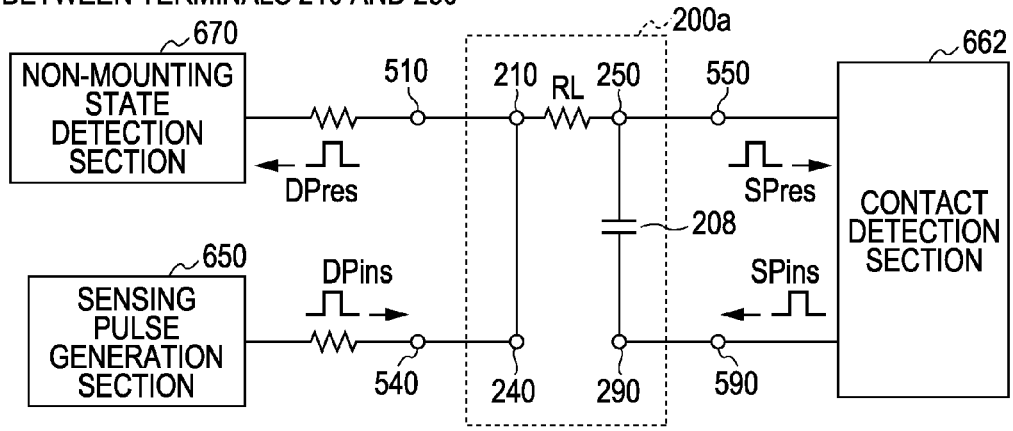

FIG. 15C shows an equivalent circuit in a case where a leak is present between the terminals 210 and 250. Here, a leak state between the terminals 210 and 250 is simulated by a resistance RL. A circuit which includes the capacity of the sensor 208 and the resistance RL between the terminals 210 and 250 functions as a high-pass filter circuit (a differentiating circuit) with respect to the first mounting inspection signal SPins. Therefore, the second mounting response signal DPres becomes a signal which presents a peak shape in the first period P21, as shown in FIG. 14B. However, in the second period P22 or later, the second mounting response signal DPres presents the same change as a change in the second mounting inspection signal DPins. The non-mounting state detection section 670 can identify the presence of a leak between the terminals 210 and 250 by examining the voltage level of the second mounting response signal DPres at any one or a plurality of timings t21 in the period P21. In addition, in a case (FIG. 14A) where a leak is present between the terminals 240 and 290 and a case (FIG. 14B) where a leak is present between the terminals 210 and 250, the relationship between the voltage level of the signal DPres at the timing from the center to the end of the first period P21 and the voltage level of the signal DPres in the second period P22 is reversed. Therefore, by comparing the voltage levels of the signal DPres at the two timings, it is possible to accurately identify a place where a leak is present of between the terminals 240 and 290 and between the terminals 210 and 250.

In addition, a change in the second mounting response signal DPres as in FIG. 14B is obtained when an output terminal of the second mounting inspection signal DPins (that is, an output terminal of the sensing pulse generation section 650) is set to be in a high impedance state in the period P21. Therefore, for example, if the second mounting inspection signal DPins is set to be in a high impedance state in the period P21, even if the second mounting inspection signal DPins is set to be a low level in the periods P22 and P23, it is possible to detect a leak state between the terminals 210 and 250.

Also in a case where a leak is present between the terminals 210 and 250, the first mounting response signal SPres presents a distinctive change. That is, the first mounting response signal SPres rises depending on rise of the second mounting inspection signal DPins to a high level, in the periods P24 and P26. Therefore, also by examining the first mounting response signal SPres at the given timing t24 and t25 of the periods P24 and P26, it is possible to determine whether or not a leak is generated. However, with respect to a change in the first mounting response signal SPres, there is no so great difference between a case (FIG. 14A) where a leak is present between the terminals 240 and 290 and a case (FIG. 14B) where a leak is present between the terminals 210 and 250. Therefore, in the inspection of the first mounting response signal SPres at the timings t24 and t25, it is not possible to identify a place where a leak is generated from two sets of terminals. However, in a case where it is not necessary to perform this identification, it is only necessary to perform inspection of the first mounting response signal SPres.

As can be understood from the explanation of FIGS. 12 to 14B described above, by examining at least one of the two mounting inspection signals SPins and DPins, it is possible to detect whether or not a leak state is created between adjacent terminals.

Figure 16A:
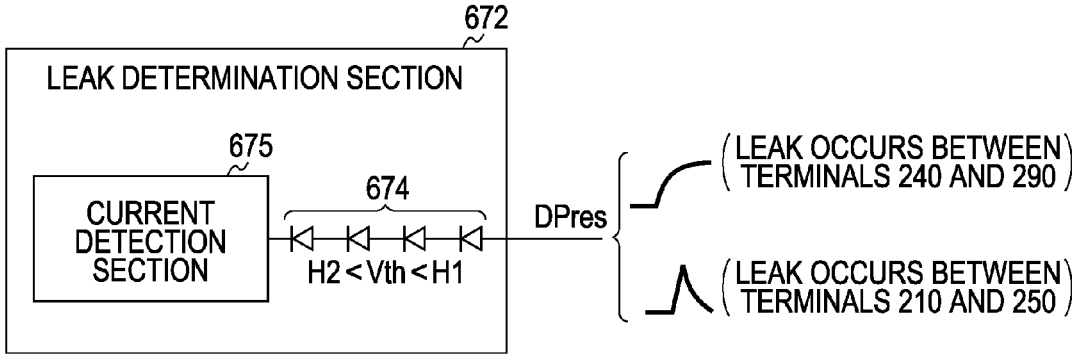
FIGS. 16A and 16B are block diagrams showing configuration examples of a leak determination section which is provided in the non-contact state detection section.
Figure 16B:
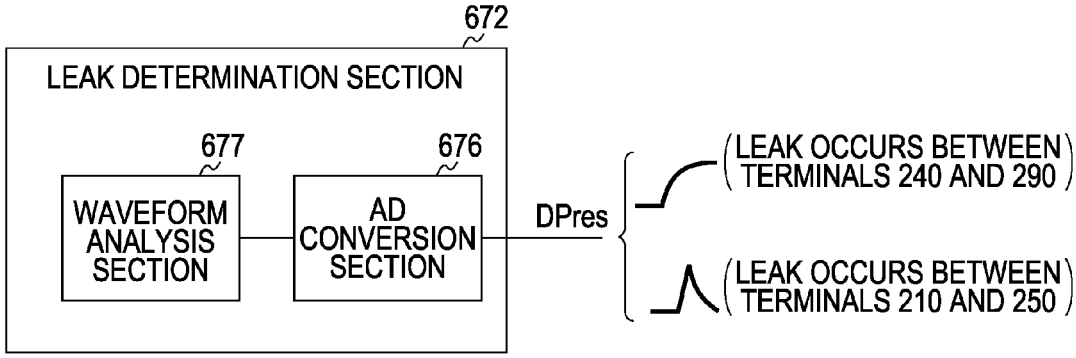

FIGS. 16A and 16B are block diagrams showing configuration examples of a leak determination section which can be used to determine the leak states shown in FIGS. 15A to 15C. The leak determination section can be provided in the non-mounting state detection section 670. A leak determination section 672 in FIG. 16A includes a voltage barrier section 674 constituted by a plurality of series-connected diodes, and a current detection section 675. A threshold voltage Vth of the voltage barrier section 674 is set to be a value lower than the high level H1 of the first mounting inspection signal SPins and higher than the high level H2 of the second mounting inspection signal DPins. Accordingly, when the voltage level of the second mounting response signal DPres has become equal to or greater than the second high level H2, an electric current flows from the voltage barrier section 674 to the current detection section 675. Therefore, the current detection section 675 can detect whether or not a leak is generated in at least one of between the terminals 240/290 and between the terminals 210/250, in accordance with whether or not an electric current is input from the voltage barrier section 674 in the period P21 in FIGS. 14A and 14B. However, in this circuit, it is not possible to identify a place where a leak is generated from between the terminals 240/290 and between the terminals 210/250.

A leak determination section 672 in FIG. 16B includes an AD conversion section 676 and a waveform analysis section 677. In this circuit, a change in the second mounting response signal DPres is digitized at the AD conversion section 676 and then supplied to the waveform analysis section 677. The waveform analysis section 677 can determine a leak state by analyzing the shape of a waveform. For example, in a case where the second mounting response signal DPres in the period P21 in FIGS. 14A and 14B is a signal (an upward convex signal which gently rises) passed through a low-pass filter, it can be determined that a leak is present between the terminals 240/290. On the other hand, in a case where the second mounting response signal DPres is a signal (a signal which presents a sharp peak) passed through a high-pass filter, it can be determined that a leak is present between the terminals 210/250. In addition, an operation clock frequency of the AD conversion section 676 is set to be a frequency sufficiently high for such a waveform analysis. The waveform analysis section 677 can seek for a time constant of a change in the second mounting response signal DPres and calculate a resistance value and a capacitance value of an equivalent circuit in a leak state. For example, in the equivalent circuits in FIGS. 15B and 15C, only the resistance RL between the terminals where a leak is generated is unknown and the resistance value of another resistance or the capacitance value of the capacitive element 208 is known. Therefore, the resistance RL between the terminals where a leak is generated can be calculated from a time constant of a change in the second mounting response signal DPres. In addition, as the configuration of the leak determination section, it is possible to adopt various circuit configurations other than these.

As can be understood from the explanation of FIGS. 12 to 16B described above, by examining at least one of (i) whether or not the second mounting response signal DPres is affected by the first mounting inspection signal SPins (DPres in FIGS. 14A and 14B) and (ii) whether or not the first mounting response signal SPres is affected by the second mounting inspection signal DPins (SPres in FIGS. 14A and 14B), it is possible to determine whether or not a leak is present between the terminals 250/290 or the terminals 210/240. As the two mounting inspection signals SPins and DPins, it is preferable to use signals having different signal waveforms in which voltage levels respectively changes, not a signal in which a voltage level is constant (for example, a signal which is always maintained at a low level or a high level). In addition, it should be noted that the signal waveforms in FIGS. 12 to 14B are simplified and depicted.

In a case where a leak has been detected in at least one of the two overvoltage detection terminals 210 and 240, the leak generation place may also be recorded in a nonvolatile memory (not shown) in the printer. Then, by performing adjustment of a contact point or a spring of a terminal of the contact mechanism 1400 (FIG. 6B) in the printer by examining the position of a terminal where leak is apt to occur, at the time of maintenance of the printer, it is possible to carry out measures to make it difficult for a leak to occur.

Figure 17:
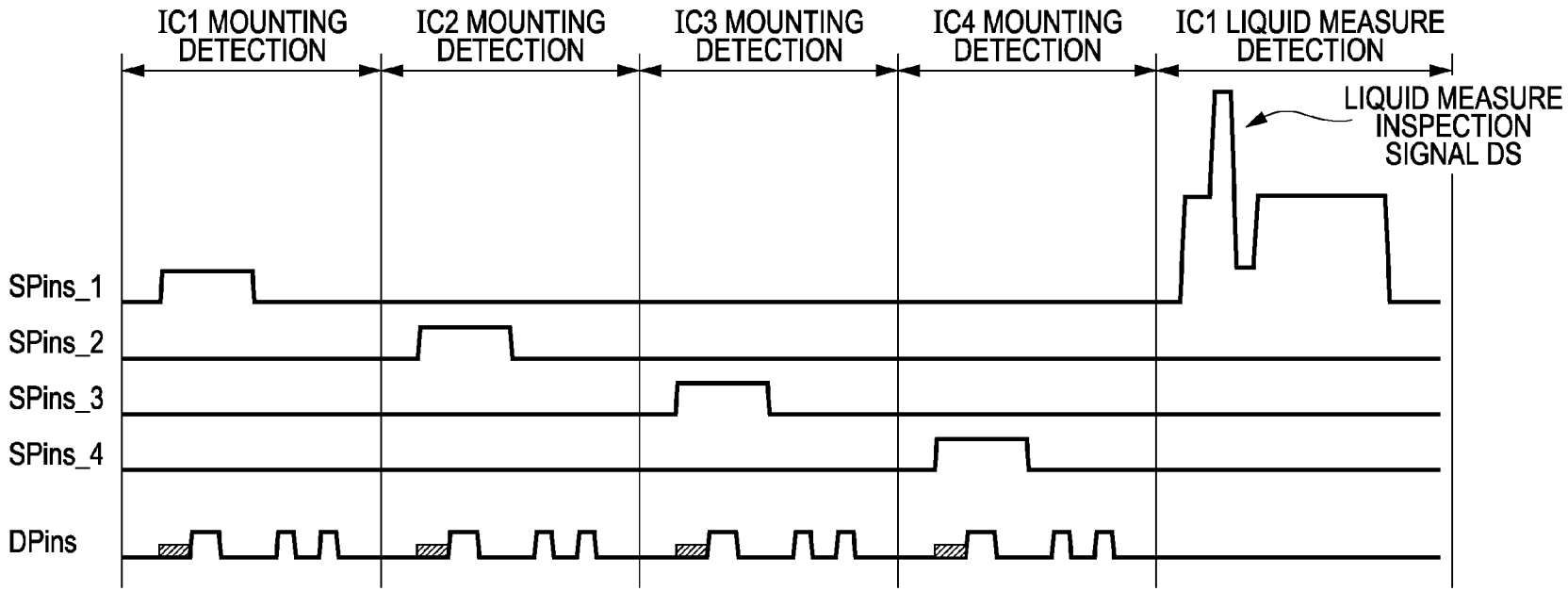
FIG. 17 is a timing chart showing the mounting detection processing with respect to four cartridges.

FIG. 17 is a timing chart of the mounting detection processing on the four cartridges IC1 to IC4. Here, the first mounting inspection signals SPins_1 to SPins_4 which are individually supplied to the individual cartridge and the second mounting inspection signal DPins which is supplied to the series connection of the terminals 240 and 210 of all the cartridges are shown. In this manner, mounting inspection on the four cartridges is sequentially performed for each cartridge, and the first and second mounting inspection signals SPins and DPins are supplied to the individual cartridge in the same period, so that the three types of mounting detection processing described above are executed. In these inspections, in a case where poor mounting (poor contact) or a leak has been detected, it is preferable to recommend a user remounting of the cartridge by displaying the effect on the display panel 430. On the other hand, as the result of these mounting inspections, in a case where poor mounting or a leak has not been detected, thereafter, detection of the amount of ink remaining of each cartridge, readout of data from the storage device 203, or the like is performed.

Figure 18:
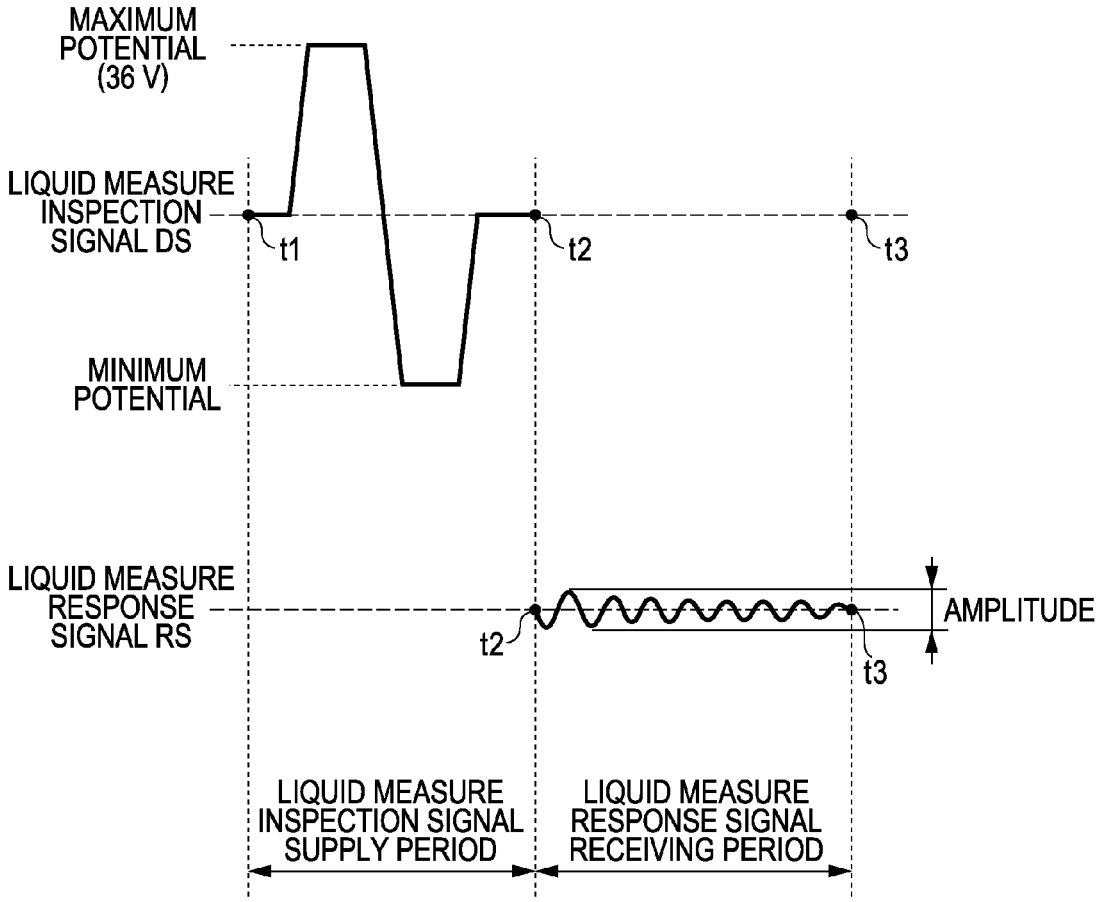
FIG. 18 is a timing chart of liquid measure detection processing.

FIG. 18 is a timing chart of liquid measure detection processing. In the liquid measure detection processing, a liquid measure inspection signal DS is supplied to the sensor terminal 290 on one side. The liquid measure inspection signal DS is supplied to an electrode on one side of a piezoelectric element constituting the sensor 208. The liquid measure inspection signal DS is an analog signal which is generated by the liquid measure detection section 664 (FIG. 10). The maximum voltage of the liquid measure inspection signal DS is, for example, about 36 V and the minimum voltage thereof is about 4 V. The piezoelectric element of the sensor 208 vibrates in response to the amount of ink remaining in the cartridge 100 and reverse voltage generated by the vibration is transmitted from the piezoelectric element to the liquid measure detection section 664 through the sensor terminal 250 on the other side as a liquid measure response signal RS. The liquid measure response signal RS includes a vibration component having a frequency corresponding to vibration the frequency of the piezoelectric element. The liquid measure detection section 664 can detect whether or not the amount of ink remaining is equal to or greater than a predetermined amount, by measuring the frequency of the liquid measure response signal RS. The ink remaining amount detection processing is the high-voltage processing of supplying the high-voltage signal DS having a voltage level higher than that of the first mounting inspection signal DPins used for the above-described leak inspection (the leak detection processing), to the sensor 208 through the terminals 250 and 290.

In this manner, at the time of detection of the amount of ink remaining, the liquid measure inspection signal DS having high voltage is applied to the sensor terminals 250 and 290. In a case where insulation between the sensor terminals 250 and 290 and the overvoltage detection terminals 210 and 240 is insufficient, abnormal high-voltage ("overvoltage") occurs in the terminals 210 and 240. In this case, since an electric current flows to the overvoltage detection section 620 through the diodes 641 to 645 (FIG. 10), the overvoltage detection section 620 can determine the presence or absence of generation of overvoltage. If overvoltage is detected, a signal indicating the generation of overvoltage is supplied from the overvoltage detection section 620 to the liquid measure detection section 664, and in response to this, the liquid measure detection section 664 immediately stops output of the liquid measure inspection signal DS. This is for preventing damage to the cartridge or the printer which can be caused by overvoltage. That is, in a case where insulation between the sensor terminal 250 (or 290) and the overvoltage detection terminal 210 (or 240) is insufficient, there is concern that insulation between the sensor terminal and the terminal for storage device may also become insufficient. At this time, if overvoltage is generated in the overvoltage detection terminals 210 and 240, the overvoltage is also applied to the terminal for storage device, so that there is a possibility that damage may occur in the storage device which is connected to the terminal for storage device, or a circuit of the printer. Therefore, when overvoltage has been detected, if output of the liquid measure inspection signal DS is immediately stopped, it is possible to prevent damage to the cartridge or the printer which can be caused by overvoltage.

In addition, as explained in FIGS. 12 to 17, the plural types of mounting state detection processing are executed ahead of the detection of the amount of ink remaining. In the leak state detection processing of these, as explained in FIGS. 14A to 16B, whether or not a low-resistance leak state is generated between the terminals 240/290 or between the terminals 210/250 is detected. That is, in the leak state detection processing, it is possible to detect whether or not a low resistance state having a certain resistance value (for example, 10 kΩ) or less is created between the terminals 240/290 or between the terminals 210/250, by using the mounting inspection signals SPins and DPins having a relatively low voltage level (about 3 V). Further, in a case where it has been determined that there is no leak between these terminals, it is ensured that the resistance value between the terminals 240/290 or between the terminals 210/250 is equal to or more than the above resistance value (about 10 kΩ). Therefore, after the leak state detection processing, even if the detection processing of the amount of ink remaining is executed by using a signal having a higher voltage level (about 36 V), overvoltage which is applied to the overvoltage detection terminals 210 and 240 does not become an extremely large value. In this manner, in the first embodiment of the printing system, the leak state between the terminals 240/290 or between the terminals 210/250 is examined using a signal having a relatively low voltage level, and as a result, only in a case where there is no leak, a signal having a relatively high voltage level is applied to the terminals 250 and 290. Therefore, compared to a case where the inspection of a leak state is not performed, it is possible to more lower the level of overvoltage which may occur in the printer or the cartridge.

Figure 19A:
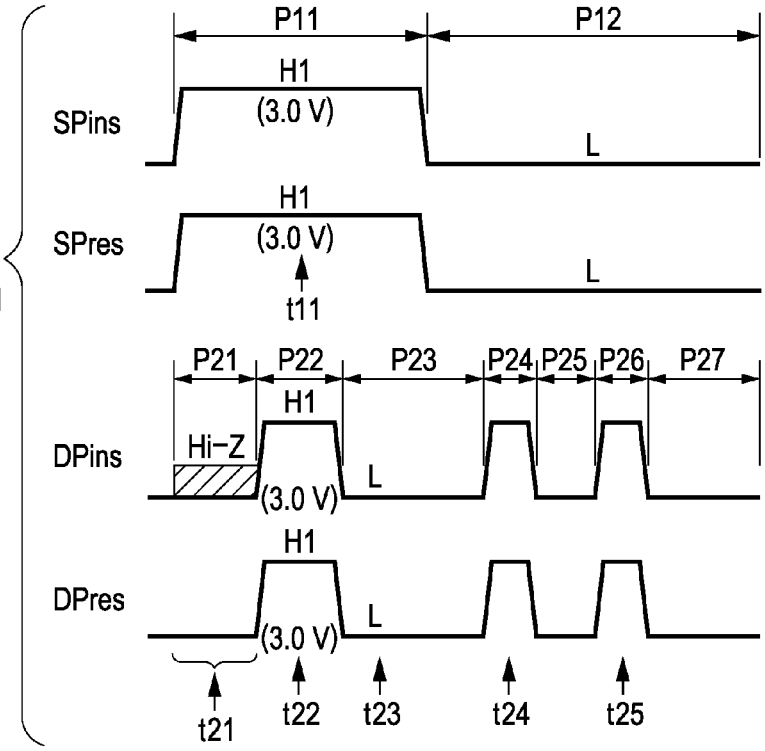
FIGS. 19A and 19B are timing charts showing other examples of a signal which is used in the mounting detection processing.

FIG. 19A is a timing chart showing a first modified example of the signal which is used in the mounting detection processing of the first embodiment of the printing system. This example differs from that of FIG. 12 in that the values of the high levels of the second mounting detection signals DPins and DPres are set to be the same as those of the first mounting detection signals SPins and SPres, and the others are the same as the signals of FIG. 12. Even if these signals are used, it is possible to perform various mounting state detection processing explained in FIGS. 13A to 16B, in approximately the same way. However, in this case, since the level of the second mounting response signal DPres in the second period P22 in FIG. 14A becomes equal to the level H1 in the first period P21, it is not possible to determine that a leak is present between the terminals 240/290, from the difference between the levels of the second mounting response signal DPres in the first and second period P21 and P22. However, as shown in FIGS. 14A and 14B, it is still possible to distinguish a place where a leak is generated from between the terminals 240/290 and between the terminals 210/250, from a change in the level of the second mounting response signal DPres in the first period P21.

Figure 19B:
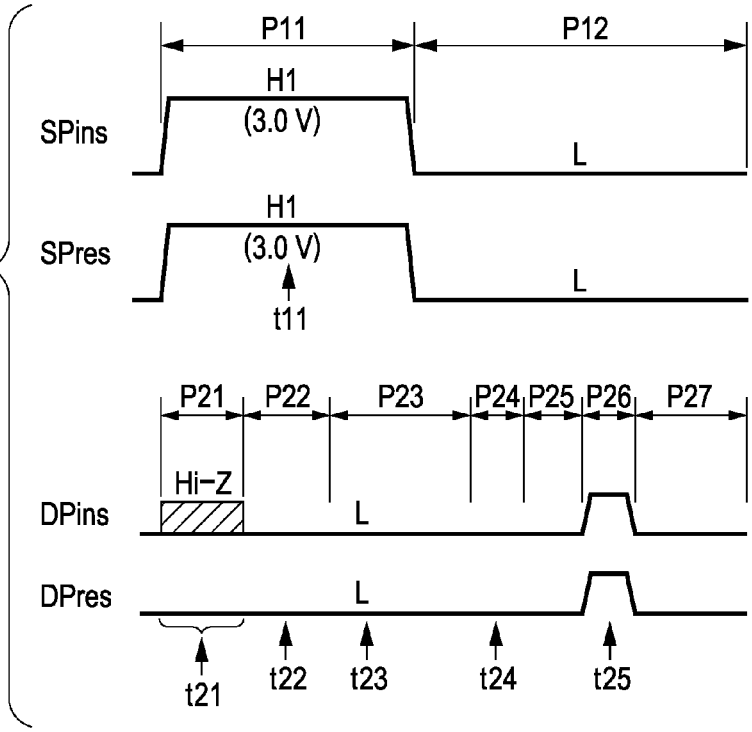

FIG. 19B is a timing chart showing a second modified example of the signal which is used in the mounting detection processing of the first embodiment of the printing system. This example differs from that of FIG. 12 in that the second mounting inspection signal DPins is set to a low level in the second period P22 and the fourth period P24 and that in response to this, the second mounting response signal DPres is maintained at a low level through the periods P21 to P25, and the others are the same as the signals of FIG. 12. Even if these signals are used, it is possible to perform various mounting detections explained in FIGS. 13A to 16B, in approximately the same way. In this case, although the determinations at the timings t22 and t24 in FIG. 13B cannot be made, the determinations at the other timings explained in FIGS. 13A, 13B, 14A, and 14B are still possible.

As can be understood from the examples of various signals in FIGS. 12, 19A, and 19B, as the voltage levels or the waveforms of the mounting detection signals (the contact detection signals), various modifications are possible. However, in the case of performing the detections of the leak states between the terminals 240/290 and between the terminals 210/250, it is preferable to change the second mounting detection signal DPins (or a signal line thereof) from a low level to a high impedance state or maintain it at a low level, when the first mounting detection signal SPins becomes a high level.

As described above, in the first embodiment of the printing system, since the contact portions of the mounting detection terminals are provided at four corners around the contact portions of the plurality of terminals for storage device of the substrate and more specifically, provided outside an area where the plurality of terminals for storage device of the substrate are disposed and at four corners of a rectangular area which includes the area, by confirming that these mounting detection terminals and the corresponding apparatus-side terminals are in excellent contact states, it is possible to secure excellent contact states also with respect to the terminals for storage device. Further, in the first embodiment of the printing system, by examining at least one of the first mounting response signal SPres related to a pair of terminals 250 and 290 of the substrate and the second mounting response signal DPres related to another pair of terminals 210 and 240, it is possible to simultaneously carry out the mounting detection processing of whether or not all the cartridges have been mounted and the leak state detection processing of whether or not a leak is present between the terminals. Further, in the first embodiment of the printing system, since the above leak state detection processing is performed by using relatively low voltage (about 3 V) ahead of the high-voltage processing of applying relatively high voltage (about 36 V) to the terminals 250 and 290, it is possible to prevent extremely high overvoltage from leaking from the terminals 250 and 290, thereby damaging the cartridge or the printer.

C. Second Embodiment of Printing System

Figure 20:
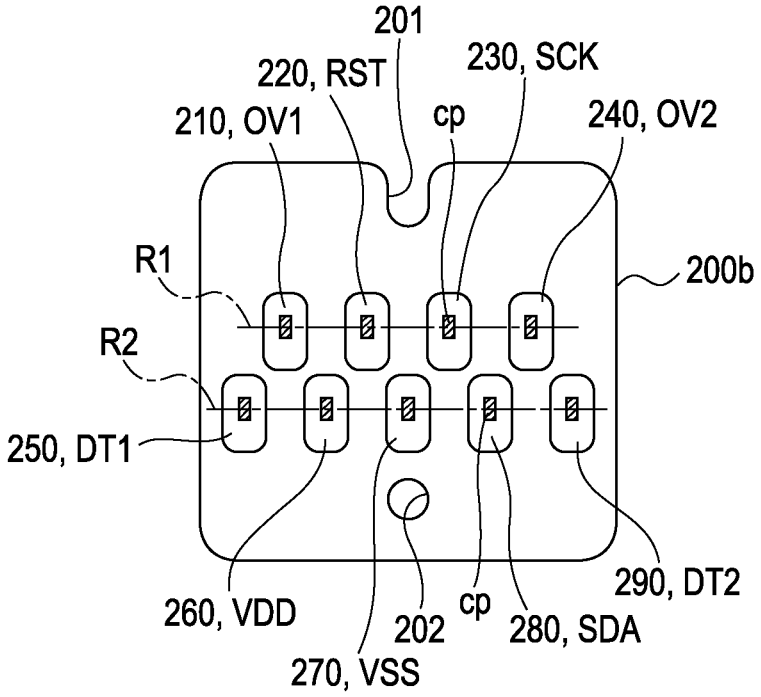
FIG. 20 is a diagram showing the configuration of a substrate in the second embodiment of the printing system.

FIG. 20 is a diagram showing the configuration of a substrate in the second embodiment of the printing system. The array of the terminals 210, 220, 230, 240, 250, 260, 270, 280, and 290 is the same as that shown in FIG. 8. However, the function (use) of each terminal is as follows and is slightly different from that in the first embodiment of the printing system.

The upper row R1

(1) Overvoltage detection terminal 210 (also used for mounting detection)

(2) Reset terminal 220

(3) Clock terminal 230

(4) Overvoltage detection terminal 240 (also used for mounting detection)

The lower row R2

(5) Mounting detection terminal 250

(6) Power supply terminal 260

(7) Earth terminal 270

(8) Data terminal 280

(9) Mounting detection terminal 290

The functions and the uses of the terminals 210, 220, 230, and 240 of the upper row R1 are approximately the same as those in the first embodiment of the printing system. The terminals 250 and 290 of the lower row R2 differ from those in the first embodiment of the printing system in that they are used for the mounting detection which uses a resistor element provided in the cartridge 100. In addition, the point that the contact portions of the terminals 210, 240, 250, and 290 located at four corners around the contact portions of the group of the terminals 210, 220, 230, 240, 250, 260, 270, 280, and 290 are used for the mounting detection (the contact detection) is the same as that in the first embodiment of the printing system. In addition, also in the second embodiment of the printing system, the same voltage as the first power-supply voltage VDD for driving the storage device, or the voltage generated from the first power-supply voltage VDD is applied to the contact portions of the two terminals 210 and 240 disposed at both ends of the upper row R1, and the same voltage as the second power-supply voltage VHV which is used to drive the printing head, or the voltage generated from the second power-supply voltage VHV is applied to the contact portions of the two terminals 250 and 290 disposed at both ends of the lower row R2. Here, as "the voltage generated from the second power-supply voltage VHV", it is preferable to use voltage higher than the first power-supply voltage VDD and lower than the second power-supply voltage VHV.

Figure 21:
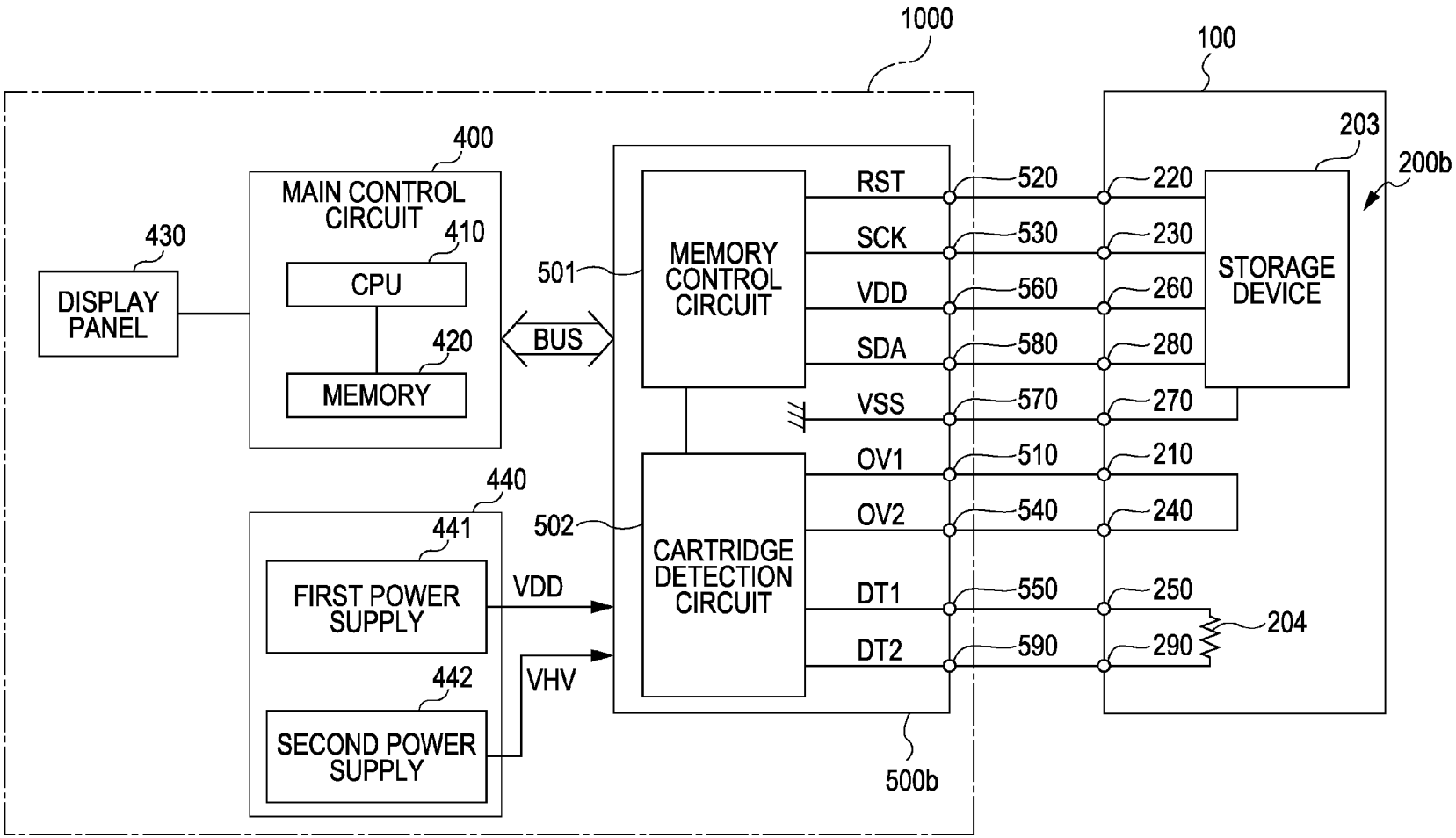
FIG. 21 is a block diagram showing the electrical configurations of the ink cartridge and the printer in the second embodiment of the printing system.

FIG. 21 is a block diagram showing the electrical configurations of a substrate 200*b* of the cartridge in the second embodiment of the printing system and the printer 1000. The substrate 200*b* has a resistor element 204 which is used for the mounting detection of the individual cartridge, in addition to the storage device 203 and the nine terminals 210, 220, 230, 240, 250, 260, 270, 280, and 290.

The main control circuit 400 includes the CPU 410 and the memory 420, similarly to the first embodiment of the printing system. A sub-control circuit 500*b* includes the memory control circuit 501 and a cartridge detection circuit 502.

The cartridge detection circuit 502 is a circuit for performing the mounting detection of the cartridge in the cartridge mounting section 1100. Therefore, it is also possible to refer to the cartridge detection circuit 502 as a "mounting detection circuit". The cartridge detection circuit 502 and the resistor element 204 of the cartridge are high-voltage circuits which operate at voltage (in this embodiment, rating 42 V) high compared to the storage device 203. The resistor element 204 is a device to which high voltage is applied from the cartridge detection circuit 520.

Figure 22:
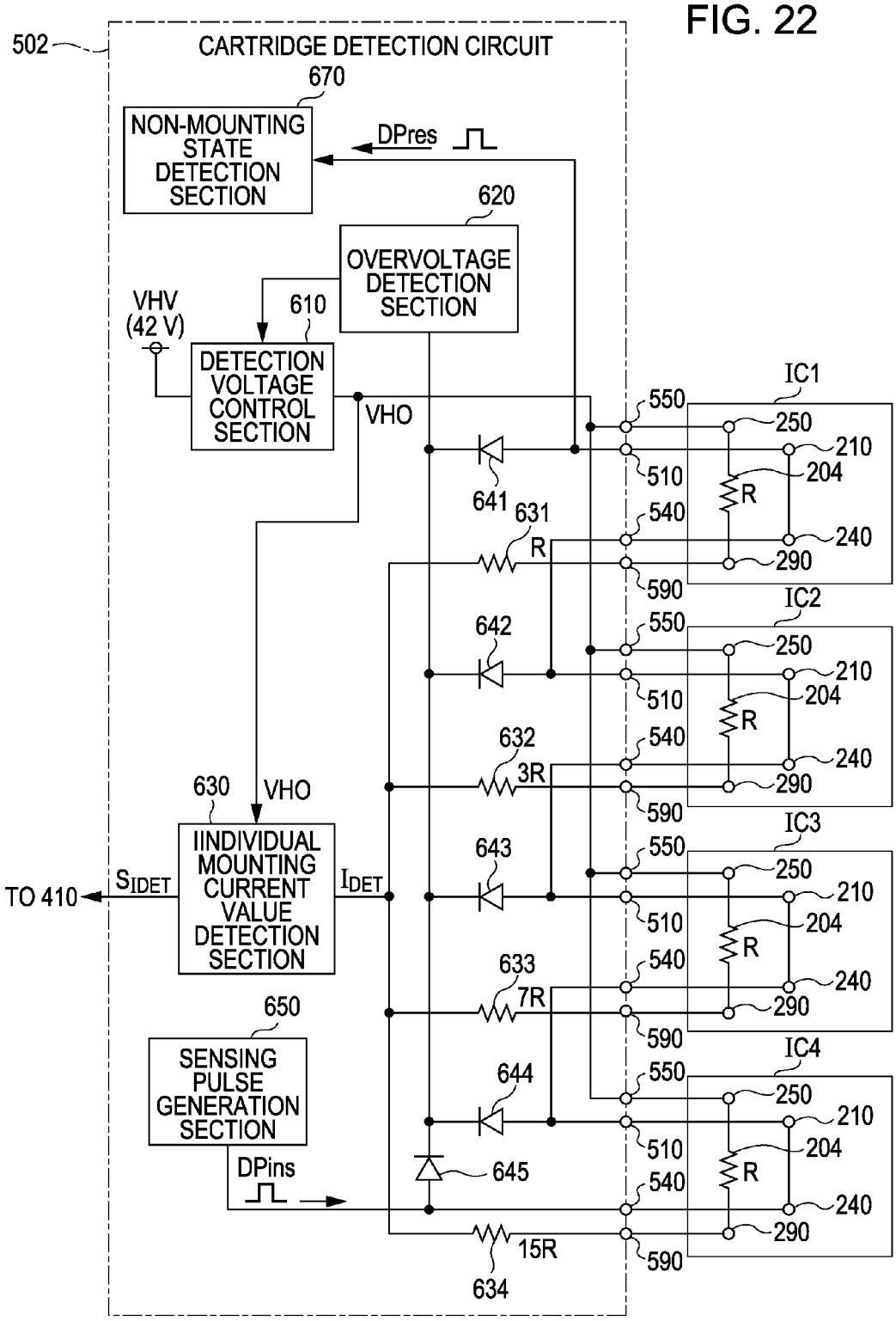
FIG. 22 is a diagram showing the internal configurations of a cartridge detection circuit in the second embodiment of the printing system.

FIG. 22 is a diagram showing the internal configuration of the cartridge detection circuit 502 in the second embodiment of the printing system. Here, a state where the four cartridges 100 have been mounted on the cartridge mounting section is shown, and reference numerals IC1 to IC4 are used to distinguish the respective cartridges. The cartridge detection circuit 502 includes a detection voltage control section 610, an overvoltage detection section 620, an individual mounting current value detection section 630, a sensing pulse generation section 650, and a non-mounting state detection section 670. Among these circuits, the overvoltage detection section 620, the sensing pulse generation section 650, and the non-mounting state detection section 670 have approximately the same configurations and functions as the circuits shown in FIG. 10. The detection voltage control section 610 has a function to control voltage which is supplied to the terminal 250 of the cartridge.

The high power-supply voltage VHV for the mounting detection is supplied to the cartridge detection circuit 502. The high power-supply voltage VHV is a voltage for driving the printing head and is supplied from the second power supply 442 (FIG. 21) to the detection voltage control section 610. An output terminal of the detection voltage control section 610 is connected in parallel to the four apparatus-side terminals 550 provided at the mounting positions of the respective cartridges IC1 to IC4. In addition, the high power-supply voltage VHV is referred to as "high voltage VHV". A voltage value VHO of the output terminal of the detection voltage control section 610 is also supplied to the individual mounting current value detection section 630. Each apparatus-side terminal 550 is connected to the first mounting detection terminal 250 of a corresponding cartridge. In each cartridge, the resistor element 204 is provided between the first and second mounting detection terminals 250 and 290. The resistance values of the resistor elements 204 of the four cartridges IC1 to IC4 are set to be the same value R. In the cartridge detection circuit 502, resistor elements 631 to 634 which are respectively connected in series to the resistor elements 204 of the respective cartridges are provided.

In each cartridge, the first and second overvoltage detection terminals 210 and 240 are short-circuited and connected to each other by a wiring. Further, these overvoltage detection terminals 210 and 240 are connected to the overvoltage detection section 620 through the apparatus-side terminals 510 and 540 and diodes 641 to 645 provided in the cartridge detection circuit 502. The connection relationships and the functions of the terminals 210, 240, 510, and 540, the diodes 641 to 645, and the overvoltage detection section 620 are the same as those explained in the first embodiment (FIG. 10) of the printing system.

Figure 23A:
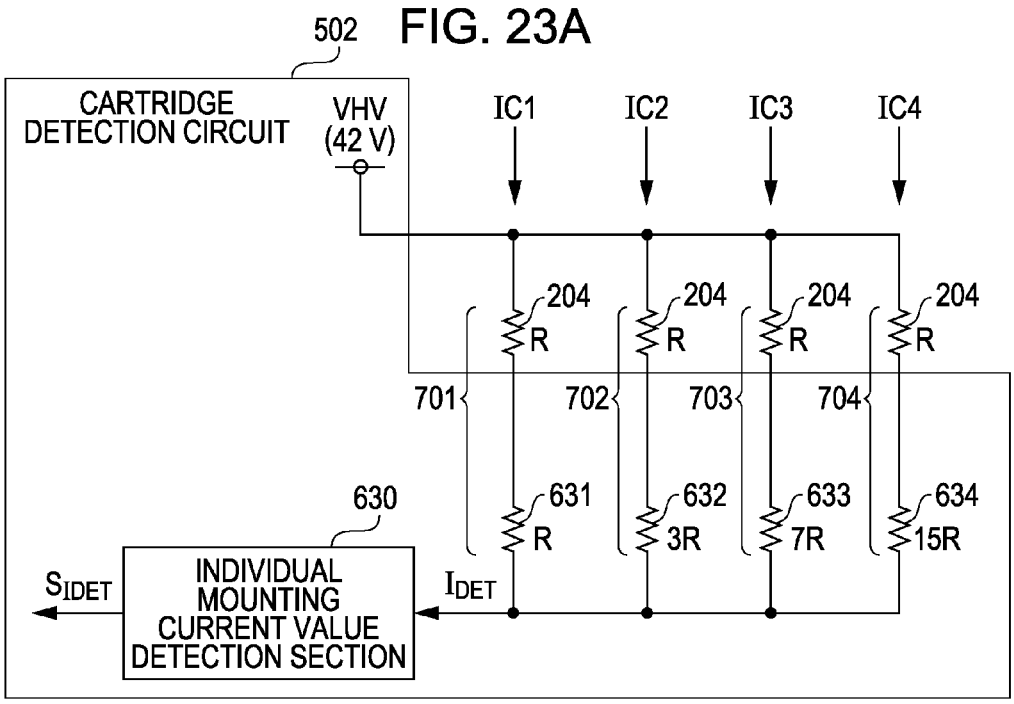
FIGS. 23A and 23B are explanatory diagrams showing the contents of cartridge mounting detection processing in the second embodiment of the printing system.
Figure 23B:
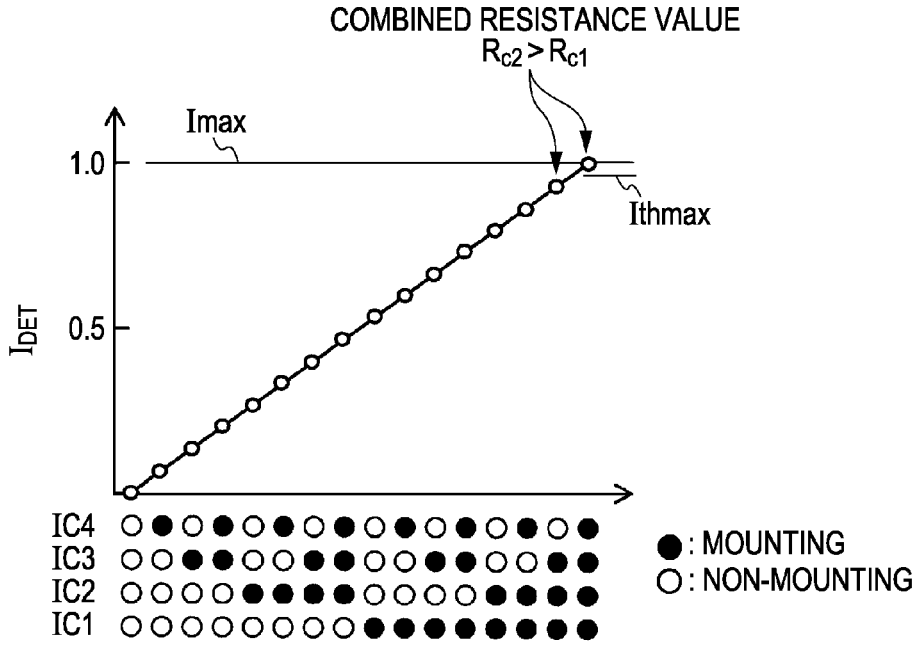

FIGS. 23A and 23B are explanatory diagrams showing the contents of the cartridge mounting detection processing in the second embodiment of the printing system. In FIG. 23A, a state where all of the cartridges IC1 to IC4 capable of being mounted on the cartridge mounting section 1100 of the printer have been mounted is shown. The resistance values of the resistor elements 204 of the four cartridges IC1 to IC4 are set to be the same value R. In the cartridge detection circuit 502, the resistor elements 631 to 634 which are respectively connected in series to the resistor elements 204 of the respective cartridges are provided. The resistance values of these resistor elements 631 to 634 are set to be different values. Specifically, the resistance value of a resistor element 63*n* correlated with the n-th (n=1 to 4) cartridge ICn among these resistor elements 631 to 634 is set to be $(2^n-1)R$ (R is a constant value). As a result, a resistance having a resistance value of $2^nR$ is formed by the series connection of the resistor element 204 in the n-th cartridge and the resistor element 63*n* in the cartridge detection circuit 502. The resistance of $2^nR$ with regard to the n-th (n=1 to N) cartridge is connected in parallel to the individual mounting current value detection section 630. In addition, in the following, series-connected resistances 701 to 704 are also referred to as "resistances for mounting detection" or simply "resistances". A detection current $I_{DET}$ which is detected at the individual mounting current value detection section 630 is a value VHV/Rc which is obtained by dividing the voltage VHV by a combined resistance value Rc of the four resistances 701 to 704. Here, when the number of cartridges is set to be N, in a case where all of N pieces of cartridges have been mounted, the detection current $I_{DET}$ is given by the following expressions.

$$I_{DET} = \frac{VHV}{R_c} \tag{1}$$

$$R_c = R\frac{1}{\sum_{j=1}^{N}\frac{1}{2^j}} \tag{2}$$

If one or more of the cartridges is not mounted, the combined resistance value Rc rises in response to this and the detection current $I_{DET}$ is lowered.

FIG. 23B shows the relationship between the mounting states of the cartridges IC1 to IC4 and the detection current $I_{DET}$. The horizontal axis of the drawing shows 16 types of mounting states and the vertical axis shows the values of the detection current $I_{DET}$ in these mounting states. The 16 types of mounting states correspond to 16 combinations which are obtained by optionally selecting 1 to 4 pieces from the four cartridges IC1 to IC4. In addition, the individual combination is also referred to as a "sub-set". The detection current $I_{DET}$ becomes a current value capable of uniquely identifying the 16 types of mounting states. In other words, the respective resistance values of the four resistances 701 to 704 correlated with the four cartridges IC1 to IC4 are set such that 16 types of mounting states that the four cartridges can take give different combined resistance values Rc.

If all of the four cartridges IC1 to IC4 are in the mounted states, the detection current $I_{DET}$ becomes the maximum value Imax. On the other hand, in a state where only the cartridge IC4 correlated with the resistance 704 having the largest resistance value is not mounted, the detection current $I_{DET}$ becomes 0.93 times the maximum value Imax. Therefore, if examination of whether or not the detection current $I_{DET}$ is equal to or more than a threshold current Ithmax preset as a value between the two current values is performed, it is possible to detect whether or not all of the four cartridges IC1 to IC4 have been mounted. In addition, the reason to use the voltage VHV higher than the power-supply voltage (about 3.3 V) of a usual logic circuit for individual mounting detection is for increasing detection precision by widely taking a dynamic range of the detection current $I_{DET}$.

The individual mounting current value detection section 630 converts the detection current $I_{DET}$ into a digital detection signal $S_{IDET}$ and then transmits the digital detection signal $S_{IDET}$ to the CPU 410 (FIG. 21). The CPU 410 can determine which of 16 types of mounting states is relevant, from the value of the digital detection signal $S_{IDET}$. In a case where it is determined that one or more of the cartridges are not mounted, the CPU 410 displays the information (characters or an image) indicating the non-mounting state on the display panel 430, thereby giving notice to a user.

The above-described cartridge mounting detection processing uses the detection current $I_{DET}$ which is uniquely determined in response to the combined resistance value Rc which uniquely determined depending on $2^N$ types of mounting states related to N pieces of cartridges. Here, an allowable error of each of the resistance values of the resistances 701 to 704 is presumed to be $\epsilon$. Further, if a first combined resistance value in a state where all the cartridges IC1 to IC4 have been mounted is set to be $R_{c1}$ and a second combined resistance value in a state where only the fourth cartridge IC4 is not mounted is set to be $R_{c2}$, the relationship of $R_{c1}<R_{c2}$ is established (FIG. 23B). It is preferable that the relationship of $R_{c1}<R_{c2}$ be also established in a case where the resistance value of each of the resistances 701 to 704 varies within a range of an allowable error $\pm\epsilon$. At this time, the worst-case condition is a case where the first combined resistance value $R_{c1}$ takes the maximum value $R_{c1max}$ thereof and the second combined resistance value $R_{c2}$ takes the minimum value $R_{c2min}$ thereof when the allowable error $\pm\epsilon$ has been considered. In order to allow these combined resistance values $R_{c1max}$ and $R_{c2min}$ to be identified, it is acceptable if a condition of $R_{c1max}<R_{c2min}$ is satisfied. The following expression can be derived from the condition of $R_{c1max}<R_{c2min}$.

$$\varepsilon < \frac{1}{4(2^{N-1}-1)} \tag{3}$$

That is, if the allowable error $\pm\epsilon$ satisfies the Expression 3, it is possible to ensure that the combined resistance value Rc is always uniquely determined depending on the mounting states of N pieces of cartridges and the detection current $I_{DET}$ is uniquely determined in response to this. However, it is preferable that an allowable error of a actual design resistance value be set to be a value smaller than the value of the right member of Expression 3. Further, the allowable error of each of the resistance values of the resistances 701 to 704 may also be set to be a sufficiently small value (for example, a value of 1% or less) without performing the study as described above.

Figure 24:
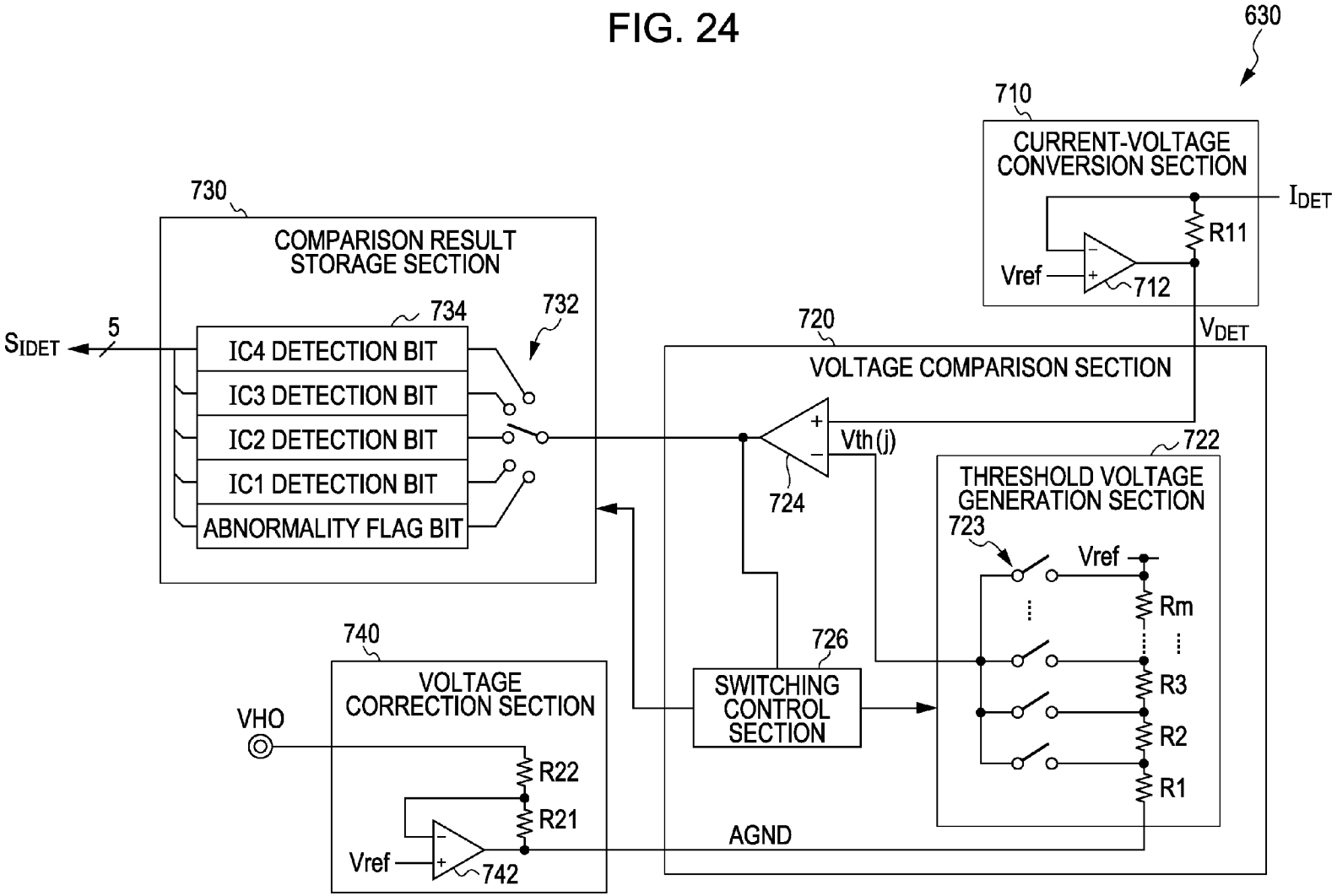
FIG. 24 is a diagram showing the internal configuration of an individual mounting current value detection section in the second embodiment of the printing system.

FIG. 24 is a diagram showing the internal configuration of the individual mounting current value detection section 630. The individual mounting current value detection section 630 includes a current-voltage conversion section 710, a voltage comparison section 720, a comparison result storage section 730, and a voltage correction section 740.

The current-voltage conversion section 710 is an inverting amplifier circuit which is constituted by an operational amplifier 712 and a feedback resistor R11. An output voltage $V_{DET}$ of the operational amplifier 712 is given by the following expression.

$$V_{DET} = Vref - I_{DET} \cdot R11 \tag{4}$$

-continued $$= Vref - (VHO - Vref)\frac{R11}{Rc}$$

Here, VHO is the output voltage of the detection voltage control section 610 (FIG. 22), and Rc is the combined resistance of the four resistances 701 to 704 (FIG. 23A). The output voltage $V_{DET}$ has a voltage value representing the detection current $I_{DET}$.

In addition, the voltage $V_{DET}$ which is given by Expression 4 represents a value in which voltage ($I_{DET}$·R11) by the detection current $I_{DET}$ is inverted. Therefore, it is also acceptable that an inverting amplifier is added to the current-voltage conversion section 710 and voltage in which the voltage $V_{DET}$ is inverted by the added inverting amplifier is output as the output voltage of the current-voltage conversion section 710. It is preferable that the absolute value of the amplification factor of the added inverting amplifier be set to be 1.

The voltage comparison section 720 includes a threshold voltage generation section 722, a comparator 724 (an operational amplifier), and a switching control section 726. The threshold voltage generation section 722 selects one of a plurality of threshold voltages Vth(j) which is obtained by voltage-dividing reference voltage Vref by a plurality of resistances R1 to Rm, by a change-over switch 723 and outputs it. The plurality of threshold voltages Vth(j) are equivalent to threshold values which distinguishes the values of the detection currents $I_{DET}$ in 16 types of mounting states shown in FIG. 23B. The comparator 724 compares the output voltage $V_{DET}$ of the current-voltage conversion section 710 with the threshold voltage Vth(j) which is output from the threshold voltage generation section 722 and outputs the comparison result of the two values. The comparison result of the two values represents whether or not the respective cartridges IC1 to IC4 are mounted. That is, the voltage comparison section 720 examines whether or not the respective cartridges IC1 to IC4 are mounted, and sequentially outputs the comparison results. In a typical example, the voltage comparison section 720 first examines whether or not the first cartridge IC1 correlated with the largest resistance 701 (FIG. 23A) is mounted, and outputs a bit value indicating the comparison result. Thereafter, the voltage comparison section 720 sequentially examines whether the second to fourth cartridges IC2 to IC4 are mounted, and outputs bit values indicating the comparison results. The switching control section 726 performs the control of switching the voltage value Vth(j) which should be output from the threshold voltage generation section 722 in order to perform the mounting detection of the next cartridge, on the basis of the comparison result with regard to each cartridge.

The comparison result storage section 730 switches the comparison result of the two values which are output from the voltage comparison section 720, by a change-over switch 732, thereby storing it at an appropriate bit position in a bit register 734. A switching timing of the change-over switch 732 is designated from the switching control section 726. The bit register 734 has N pieces (here, N=4) of cartridge detection bits indicating the presence or absence of the mounting of the individual cartridge capable of being mounted on the printer, and an abnormality flag bit indicating the detection of an abnormal current value. The abnormality flag bit becomes an H-level in a case where significantly large current flows compared to the current value Imax (FIG. 23B) in a state where all the cartridges are mounted. However, the abnormality flag bit may be omitted. A plurality of bit values stored in the bit register 734 is transmitted to the CPU 410 (FIG. 21) of the main control circuit 400 as the digital detection signal $S_{IDET}$ (a detection current signal). The CPU 410 determines whether or not the individual cartridge is mounted, from the bit value of the digital detection signal $S_{IDET}$. As described above, in the second embodiment of the printing system, four bit values of the digital detection signal $S_{IDET}$ indicate whether or not the individual cartridge is mounted. Therefore, the CPU 410 can immediately determine whether or not the individual cartridge is mounted, from the individual bit value of the digital detection signal $S_{IDET}$.

Both the voltage comparison section 720 and the comparison result storage section 730 constitute a so-called A-D conversion section. As the A-D conversion section, it is possible to adopt various other known configurations in place of the voltage comparison section 720 and the comparison result storage section 730 shown in FIG. 24.

The voltage correction section 740 is a circuit for correcting the plurality of threshold voltages Vth(j) which are generated at the threshold voltage generation section 722, following variation in the high voltage VHV for mounting detection (FIG. 22). The voltage correction section 740 is configured as an inverting amplifier circuit constituted by an operational amplifier 742 and two resistances R21 and R22. The output terminal voltage VHO of the detection voltage control section 610 in FIG. 22 is input to an inverting input terminal of the operational amplifier 742 through the input resistance R22, and the reference voltage Vref is input to a non-inverting input terminal of the operational amplifier 742. At this time, an output voltage AGND of the operational amplifier 742 is given by the following expression.

$$AGND = Vref - (VHO - Vref)\frac{R21}{R22} \tag{5}$$

The voltage AGND is used as reference voltage AGND on the low-voltage side of the threshold voltage generation section 722. For example, if Vref is set to be 2.4 V, VHO is set to be 42 V, R21 is set to be 20 kΩ, and R22 is set to be 400 kΩ, AGND becomes 0.42 V. As can be understood by comparing the above-described Expression 4 with the above-described Expression 5, the reference voltage AGND on the low-voltage side of the threshold voltage generation section 722 changes depending on the value of the output voltage VHO (that is, the high-voltage power supply VHV for mounting detection) of the detection voltage control section 610, similarly to the detection voltage value $V_{DET}$. The difference between the two voltages AGND and $V_{DET}$ occurs from the difference between resistance ratios R21/R22 and R11/Rc. If such a voltage correction section 740 is used, even if the power-supply voltage VHV for mounting detection varies for some reason, a plurality of thresholds voltages Vth(j) which are generated at the threshold voltage generation section 722 changes following variation in the power-supply voltage VHV. As a result, since both the detection voltage value $V_{DET}$ and the plurality of threshold voltages Vth(j) change following variation in the power-supply voltage VHV, it is possible to obtain a comparison result representing an accurate mounting state in the voltage comparison section 720. In particular, if the values of the resistance ratio R21/R22 and a resistance ratio R11/$R_{c1}$ ($R_{c1}$ is a combined resistance value at the time of mounting of all the cartridges) are set to the same, it is possible to make the detection voltage value $V_{DET}$ and the plurality of thresholds voltages Vth(j) accurately follow so as to change approximately with the same variation width with respect to variation in power-supply voltage VHV. However, the voltage correction section 740 may also be omitted.

Figure 25:
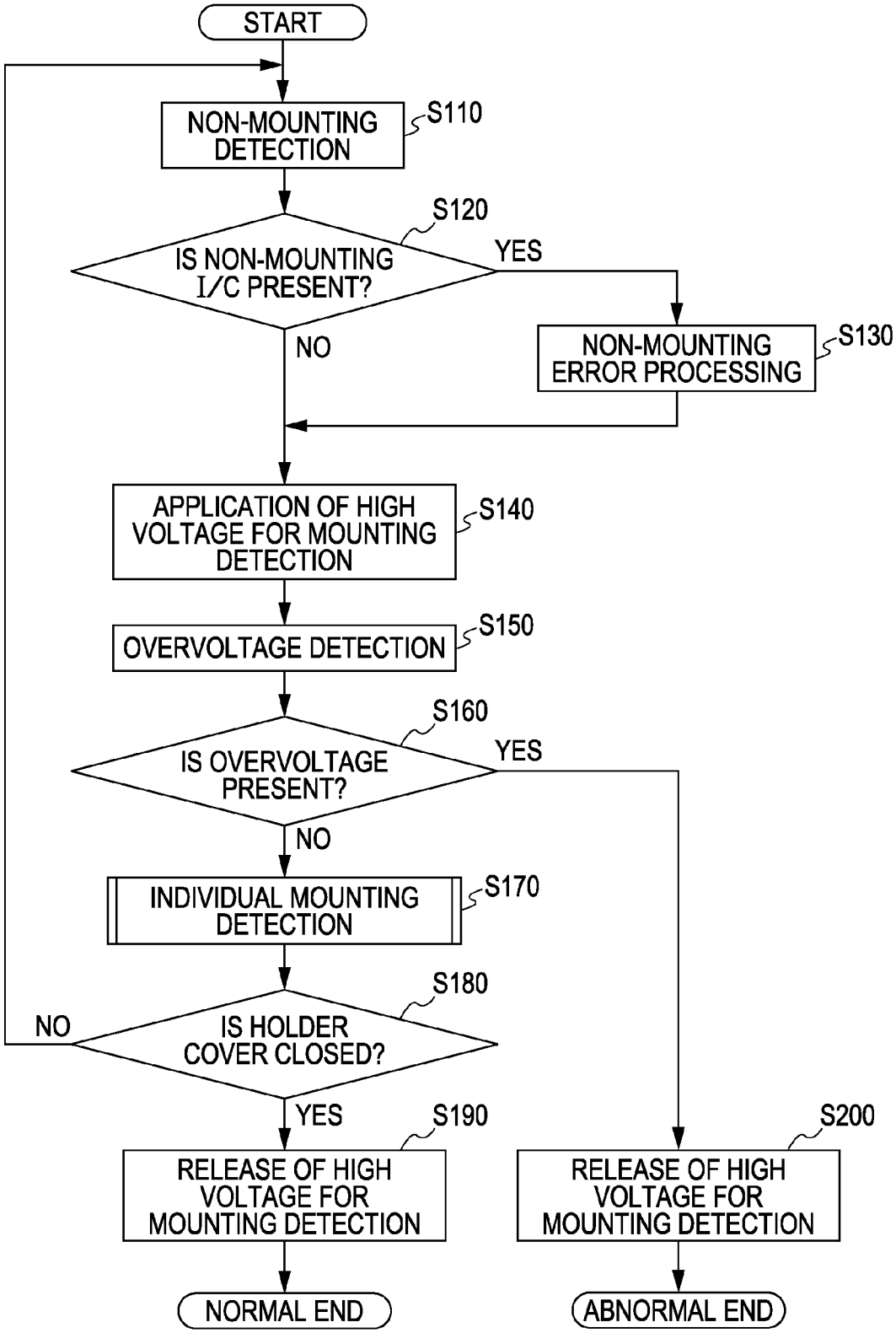
FIG. 25 is a flowchart showing an overall procedure of the mounting detection processing in the second embodiment of the printing system.

FIG. 25 is a flowchart showing an overall procedure of the mounting detection processing which is performed by the cartridge detection circuit 502. The mounting detection processing is started when the cover 1200 (FIG. 4) of the cartridge mounting section 1100 is opened. In this processing, the storage device 203 of each cartridge is maintained in a non-energized state (a state where the power-supply voltage VDD is not supplied).

In Steps S110 and S120, the processing of detecting a non-mounting state explained in FIG. 25 is executed. As a result, if all the cartridges have been mounted, the process proceeds from Step S120 to Step S140 which will be described later. On the other hand, in a case where non-mounting of one or more of the cartridges has been detected, in Step S130, the main control circuit 400 executes non-mounting error processing. The non-mounting error processing is the processing of displaying the notice that "a cartridge is not correctly mounted" (the notice of the effect that there is a non-mounted cartridge) on, for example, the display panel 430. In Step S140, the detection voltage control section 610 (FIG. 22) of the cartridge detection circuit 502 applies the high voltage VHV (42 V) for mounting detection to a device for mounting detection (in this embodiment, the resistor element 204) of the cartridge. In Steps S150 and S160, the overvoltage detection section 620 detects whether or not overvoltage is generated. In a case where overvoltage is generated, in Step S200, the overvoltage detection section 620 notifies the detection voltage control section 610 the generation of overvoltage and stops the supply of the high voltage VHV. In this case, the effect that overvoltage has been generated, or the instructions such as performing an operation of first detaching the cartridge and reinserting it may also be displayed on the display panel 430. On the other hand, in a case where overvoltage has not been generated, the process proceeds from Step S160 to Step S170 and the individual mounting detection processing of the cartridge explained in FIGS. 23A, 23B, and 24 is executed. The individual mounting detection processing is the high-voltage processing of supplying a high-voltage signal (42 V) having a voltage level higher than the power-supply voltage (3.3 V) for the storage device, to the resistor element 204 through the terminals 250 and 290. In addition, in the individual mounting detection processing of Step S170, in a case where one or more of the cartridges have not been mounted, a determination result (the type of non-mounted cartridge) may also be displayed on the display panel 430. For example, as the determination result, a non-mounting position among the mounting positions of a plurality of cartridges and the type (for example, a yellow cartridge) of cartridge which should be mounted at the non-mounting position may also be displayed.

If the individual mounting detection processing is ended, the process returns to Step S180 in FIG. 25 and it is determined whether or not the cover 1200 of the cartridge mounting section 1100 has been closed. If the cover 1200 has not been closed, the process returns from Step S180 to Step S110 and the above-described processing of Step S110 or later is executed again. On the other hand, if the cover 1200 has been closed, in Step S190, the detection voltage control section 610 stops the supply of the high voltage VHV and the processing is completed.

As described above, also in the second embodiment of the printing system, similarly to the first embodiment of the printing system, since the contact portions of the mounting detection terminals are provided at four corners around the contact portions of the plurality of terminals for storage device of the substrate and more specifically, provided outside an area where the plurality of terminals for storage device of the substrate are disposed and at four corners of a rectangular area which includes the area, by confirming that these mounting detection terminals and the corresponding apparatus-side terminals are in excellent contact states, it is possible to secure excellent contact states also with respect to the terminals for storage device.

Further, in the second embodiment of the printing system, since during replacement of a cartridge, the non-mounting state of the individual cartridge is displayed on the display panel 430, a user can carry out replacement of the cartridge while watching the display. In particular, since when replacing the cartridge, a change from non-mounting to mounting of the cartridge is displayed on the display panel 430, even a user unfamiliar with cartridge replacement work can proceed to the next operation with an easy mind. Further, in the second embodiment of the printing system, since it is possible to perform the cartridge mounting detection in a state where the storage device 203 of the cartridge is not energized, it is possible to prevent occurrence of a bit error which occurs due to so-called hot-swap of a storage device (an operation in which a memory control circuit of a printer performs access to a storage device of a cartridge regardless of whether or not the storage device of the cartridge is connected to an apparatus-side terminal of the printer, and during the access, the cartridge is mounted or removed).

D. Modified Examples

In addition, the invention is not limited to the above embodiments and it is possible to implement the invention in various aspects within the scope which does not depart from the gist thereof and, for example, the following modifications can also be made.

Modified Example 1

The array of the terminals or the contact portions of the substrate in each embodiment described above can be variously modified. For example, in the substrates of the above embodiments, a plurality of terminals or the contact portions thereof are disposed in two rows parallel to each other along a direction perpendicular to the mounting direction of the cartridge. However, instead, they may also be disposed in two rows along a direction parallel to the mounting direction of the cartridge. Further, they may also be disposed by being divided into three or more rows, not two rows.

Further, the number of terminals for mounting detection is optional and five or more of the terminals may also be disposed. Further, also with respect to the types or the array of a plurality of terminals for storage device, various modifications other than the above can be made. For example, the reset terminal may be omitted. However, it is preferable that a plurality of contact portions for storage device be disposed in an assembled state where the contact portions of other terminals (the terminals for mounting detection) are not interposed between the contact portions of the terminals for storage device.

Modified Example 2

In each embodiment described above, as an electric device which is mounted on the cartridge, in addition to the storage device 203, the sensor 208 (FIG. 9) or the resistor element 204 (FIG. 21) is used. However, a plurality of electric devices which are mounted on the cartridge is not limited to these and one or more of any type of electric device may also be mounted on the cartridge. For example, as a sensor for detection of the amount of ink, in place of a sensor using a piezoelectric element, an optical sensor may also be provided in the cartridge. Further, also as an electric device to which voltage higher than 3.3 V is applied, devices other than the sensor 208 (FIG. 9) or the resistor element 204 (FIG. 21) may also be used. Further, in the second embodiment of the printing system, both the storage device 203 and the resistor element 204 are provided at the substrate 200. However, the electric device of the cartridge can be disposed on any other member. For example, the storage device 203 may also be disposed on a casing of the cartridge, an adapter, or another structure separate from the cartridge. This point is also the same with respect to the first embodiment of the printing system.

Modified Example 3

In the second embodiment of the above printing system, the four resistances for mounting detection 701 to 704 are formed by the resistor element 204 in the n-th cartridge and the corresponding resistor element 63*n* (n=1 to 4) in the cartridge detection circuit 502. However, the resistance values of these resistances for mounting detection may also be realized only by one resistor element and may also be realized by three or more resistor elements. For example, the resistance for mounting detection 701 which is constituted by two resistor elements 204 and 631 may also be replaced with a single resistor element. The same is true for other resistances for mounting detection. In a case where one resistance for mounting detection is constituted by a plurality of resistor elements, distribution of the resistance values of these resistor elements can be optionally changed. Further, the single resistor element or the plurality of resistor elements may also be provided only at one of the cartridge and a main body of the printer. For example, if all the resistances for mounting detection are provided on the cartridge, a resistor element constituting the resistance for mounting detection is not required for the main body of the printer.

Modified Example 4

Among various constituent elements described in each embodiment described above, a constituent element unrelated to a specific purpose, action, and effect may be omitted. For example, since the storage device 203 in the cartridge is not used for the individual mounting detection of the cartridge, in a case where the individual mounting detection of the cartridge is a main purpose, the storage device 203 may be omitted. Further, it is also possible to omit some processing among various processing described above and a constituent element related to the processing.

Modified Example 5

In each embodiment described above, the invention is applied to the ink cartridge. However, the invention can also be similarly applied to a printing material accommodating body (a printing material accommodating container) in which another printing material, for example, toner, is accommodated.

Further, the invention is not limited to the ink jet printer and the ink cartridge thereof and can also be applied to any liquid ejecting apparatus which ejects liquid other than ink and a liquid accommodating container thereof. For example, it is possible to apply the invention to various liquid ejecting apparatuses as mentioned below and liquid accommodating containers thereof.

(1) An image recording apparatus such as a facsimile apparatus (2) A color material ejecting apparatus which is used for the manufacturing of a color filter for an image display apparatus such as a liquid crystal display (3) An electrode material ejecting apparatus which is used for formation of an electrode of an organic EL (Electro Luminescence) display, a surface-emitting display (Field Emission Display; FED), or the like (4) A liquid ejecting apparatus which ejects liquid which includes biological organic matter which is used for the manufacturing of a biochip (5) A sample electing apparatus as a precision pipette (6) A lubricant ejecting apparatus (7) A resin solution ejecting apparatus (8) A liquid ejecting apparatus which ejects lubricant to a precision machine such as a clock or a camera through a pin point (9) A liquid ejecting apparatus which ejects a transparent resin solution such as an ultraviolet curing resin solution onto a substrate in order to form a hemispherical micro-lens (an optical lens) or the like which is used in an optical communication element or the like

(10) A liquid ejecting apparatus which ejects acid or alkaline etching solution in order to etch a substrate or the like

(11) A liquid ejecting apparatus provided with a liquid ejecting head which discharges a minutely small amount of any other liquid droplet In addition, the "liquid droplet" means liquid in a state of being discharged from a liquid ejecting apparatus and is also set to include droplets of a granular shape or a tear shape, or droplets tailing into a line. Further, with respect to "liquid" as mentioned herein, it is acceptable if it is a material that a liquid ejecting apparatus can eject. For example, it is acceptable if the "liquid" is a material in a state when a substance is in a liquid phase, and a material in a liquid state with high or low viscosity and materials in a liquid state such as sol, gel water, other inorganic solvents, an organic solvent, a solution, a liquid resin, and a liquid metal (molten metal) are also included in "liquid". Further, not only liquid as one state of a substance, but also a material in which particles of a functional material composed of a solid material such as pigment or metal particles are dissolved, dispersed, or mixed in a solvent, or the like is also included in "liquid". Further, ink as described in the above embodiments, liquid crystal, or the like can be given as a representative example of liquid. Here, ink is set to include various liquid compositions such as general water-based ink and oil-based ink, gel ink, hot-melt ink.

The entire disclosure of Japanese Patent Application No. 2010-258492, filed on Nov. 19, 2010 is expressly incorporated herein by reference.

What is claimed is:

1. A circuit substrate electrically connectable to a plurality of apparatus-side terminals of a printer, the circuit substrate comprising:

a storage device;

at least one first terminal connected to the storage device;

at least one second terminal to which voltage higher than voltage which is applied to the first terminal is applied; and at least one third terminal, wherein the third terminal is disposed adjacent to the first terminal and the second terminal on the substrate surface of the circuit substrate, the third terminal is connected to an overvoltage detection section provided in the printer when the circuit substrate is connected to the plurality of apparatus-side terminals of the printer, and is used to detect overvoltage which is applied to the third terminal, and a convex portion is provided on the substrate surface between the first terminal and the second terminal, whereby in a case where a liquid droplet has been attached to the second terminal, the liquid droplet easily spreads from the second terminal to the third terminal to cause an overvoltage condition to be detected, rather than the liquid droplet spreading from the second terminal to the first terminal.

2. The circuit substrate according to claim 1, wherein the convex portion includes a resist coating provided on the surface of the convex portion.

3. The circuit substrate according to claim 2, wherein the convex portion includes a wiring laid-out so as to pass between the first terminal and the second terminal, and the resist coating which covers the wiring.

4. The circuit substrate according to claim 3, wherein the first terminal is provided in a plurality on the substrate surface, the second terminal and the third terminal are provided two each on the substrate surface, the first to third terminals are arranged so as to constitute a first row and a second row, the two second terminals are disposed at both ends of the second row, the two third terminals are disposed at both ends of the first row, the two third terminals are connected to each other through the wiring laid-out so as to pass between the first terminal and the second terminal, and the wiring which is included in the convex portion is a portion of the wiring which connects the two third terminals to each other.

* * * * *